US008233813B2

(12) United States Patent
Yoshida et al.

(10) Patent No.: US 8,233,813 B2
(45) Date of Patent: Jul. 31, 2012

(54) IMAGE FORMING APPARATUS AND IMAGE-DENSITY CONTROL METHOD

(75) Inventors: Akira Yoshida, Kanagawa (JP); Shin Hasegawa, Kanagawa (JP); Hitoshi Ishibashi, Kanagawa (JP); Yoshiaki Miyashita, Tokyo (JP); Kohta Fujimori, Kanagawa (JP); Nobutaka Takeuchi, Kanagawa (JP); Shuji Hirai, Tokyo (JP); Kayoko Tanaka, Tokyo (JP); Yushi Hirayama, Kanagawa (JP); Tetsuya Muto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 448 days.

(21) Appl. No.: 12/482,782

(22) Filed: Jun. 11, 2009

(65) Prior Publication Data

US 2009/0324267 A1 Dec. 31, 2009

(30) Foreign Application Priority Data

Jun. 30, 2008 (JP) ..... 2008-171537

(51) Int. Cl.
*G03G 15/00* (2006.01)

(52) U.S. Cl. ..... 399/49; 399/72

(58) Field of Classification Search ..... 399/49, 399/72

See application file for complete search history.

(56) References Cited

U.S. PATENT DOCUMENTS

| | | | |
|---|---|---|---|
| 5,182,600 | A | 1/1993 | Hasegawa et al. |
| 5,198,861 | A | 3/1993 | Hasegawa et al. |
| 5,327,196 | A | 7/1994 | Kato et al. |
| 5,387,965 | A | 2/1995 | Hasegawa et al. |
| 5,630,195 | A | 5/1997 | Sawayama et al. |
| 5,761,570 | A | 6/1998 | Sawayama et al. |
| 5,857,131 | A | 1/1999 | Hasegawa |
| 5,860,038 | A | 1/1999 | Kato et al. |
| 6,055,386 | A | 4/2000 | Kato et al. |
| 6,160,569 | A | 12/2000 | Fujimori et al. |
| 6,496,677 | B2 | 12/2002 | Fujimori |
| 6,975,338 | B2 | 12/2005 | Hirai et al. |
| 7,151,901 | B2 | 12/2006 | Hirai |
| 7,193,642 | B2 | 3/2007 | Hirai et al. |
| 7,228,081 | B2 | 6/2007 | Hasegawa et al. |
| 7,251,420 | B2 | 7/2007 | Fujimori et al. |
| 2004/0251435 | A1 | 12/2004 | Sawayama et al. |
| 2008/0170220 | A1 | 7/2008 | Sawayama et al. |
| 2009/0202263 | A1 | 8/2009 | Yoshida et al. |

FOREIGN PATENT DOCUMENTS

| | | |
|---|---|---|
| JP | 2004-354623 | 12/2004 |
| JP | 2006-106222 | 4/2006 |
| JP | 2006-139180 | 6/2006 |
| JP | 2008-28139 | 2/2008 |

*Primary Examiner* — David Gray

*Assistant Examiner* — Erika J Villaluna

(74) *Attorney, Agent, or Firm* — Oblon, Spivak, McClelland, Maier & Neustadt, L.L.P.

(57) ABSTRACT

An image forming apparatus forms a plurality of tone patterns of different colors, each of which containing a plurality of toner patches having different toner densities. Some of the toner patches in each of the tone patterns are formed with a predetermined fixed developing bias and the rest of the toner patches in each of the tone patterns are formed with developing biases set based on previous developing biases that have been obtained through a previous control process. The largest toner density of the toner patches in each of the tone patterns is determined based on a magnitude relation of previous index values obtained through the previous control process.

6 Claims, 10 Drawing Sheets

IMAGE FORMING APPARATUS AND IMAGE-DENSITY CONTROL METHOD

CROSS-REFERENCE TO RELATED APPLICATIONS

The present application claims priority to and incorporates by reference the entire contents of Japanese priority document 2008-171537 filed in Japan on Jun. 30, 2008.

BACKGROUND OF THE INVENTION

1. Field of the Invention

The present invention relates to a technology for formation of toner patches used to control toner density in image formation in an image forming apparatus.

2. Description of the Related Art

In an electrophotographic image forming apparatus, such as a copier or a laser beam printer, an image-density control process is performed in the following manner to ensure a stable image density. That is, a tone pattern formed of 10 to 17 toner patches is formed on an image carrier, such as a photosensitive element, under different image forming conditions (with different developing potentials) so that they the toner patches have different toner adhesion amounts (i.e., toner densities), respectively. The toner adhesion amount of each of the toner patches is calculated based on a detection value of the toner patch optically detected by an optical sensor, and a predetermined algorithm set for calculating the toner adhesion amount. Then, an equation of a straight line, that is, $y=ax+b$ is obtained based on a relationship between the toner adhesion amount of each of the toner patches and the image forming condition (the developing potential), and then a development index value $\gamma$ that is an index of development performance (i.e., the slope "a" of the graph of $y=ax+b$, with a developing potential on a horizontal axis and a toner adhesion amount on a vertical axis) and a development start voltage Vk (i.e., the intercept "b" of the graph of $y=ax+b$) are obtained. Then, image forming conditions such as a laser diode (LD) power, a charging bias, and a developing bias are adjusted based on the development index value $\gamma$ and the development start voltage Vk so that a developing potential corresponding to a proper toner adhesion amount can be obtained.

The optical sensor used for detecting the toner patches includes a light emitting element, such as a light emitting diode (LED), and a light receiving element, such as a phototransistor. The light emitting element irradiates the toner patch with a light and the light receiving element detects an amount of reflected light from the toner patch. Generally, the optical sensor can sensitively detect a toner patch having a small toner adhesion amount, but it cannot sensitively detect a toner patch having a larger toner adhesion amount than a predetermined toner adhesion amount depending on a detection sensitivity of the light receiving element. In other words, the optical sensor has a predetermined detection range in which the toner patches can be detected sensitively. Therefore, to accurately obtain the development index value $\gamma$ and the development start voltage Vk, the toner adhesion amounts of the toner patches of the tone pattern need to be distributed evenly from a small toner adhesion amount to a large toner adhesion amount within the detection range of the optical sensor in which the toner patches can be detected sensitively.

In the conventional technology, to accurately calculate the development index value $\gamma$ and the development start voltage Vk even when the development index value $\gamma$ increases or decreases, 10 to 17 toner patches having different toner adhesion amounts are formed with different fixed developing biases, respectively. The reason for this is as follows. When the development index value $\gamma$ increases, the development performance also increases, so that an image having a relatively large toner adhesion amount can be formed with a low developing bias. Accordingly, even when the toner patch is formed with a developing bias of a middle level, the toner adhesion amount thereof may be out of the detection range of the optical sensor. Therefore, to ensure the condition in which the toner adhesion amounts of the toner patches of the tone pattern are distributed evenly from a small toner adhesion amount to a large toner adhesion amount within the detection range of the optical sensor even when the development index value $\gamma$ increases, it is necessary to form a plurality of toner patches with low developing biases.

On the other hand, when the development index value $\gamma$ decreases, the development performance also decreases, so that an image having a relatively large toner adhesion amount can be formed only with a high developing bias. Therefore, if all the toner patches of the tone pattern are formed with low developing biases, and when the development index value $\gamma$ decreases, even the largest toner adhesion amount of the toner patches remains in a small toner adhesion amount range. As a result, the toner adhesion amounts of all the toner patches are concentrated in the small toner adhesion amount range. If the toner adhesion amounts of all the toner patches are concentrated in the small toner adhesion amount range, the development index value $\gamma$ and the development start voltage Vk cannot be calculated accurately because of effects of fluctuation in the toner adhesion amounts. Therefore, to accurately calculate the development index value $\gamma$ and the development start voltage Vk even when the development index value $\gamma$ decreases, a plurality of toner patches formed with high developing biases need to be prepared in addition to the toner patches formed with low developing biases.

In this manner, to accurately calculate the development index value $\gamma$ and the development start voltage Vk even when the development index value $\gamma$ increases or decreases, the toner patches need to be formed with both low developing biases and high developing biases. Therefore, in the conventional technology, at least 10 to 17 toner patches need to be formed in one tone pattern because of necessity of forming the toner patches both with low developing biases and high developing biases. However, as the number of the toner patches increases, a processing time for adjusting an image density increases and toner consumption also increases. Particularly, in a color image forming apparatus that forms an image by using four color toners Y, M, C, and K, because the tone pattern is formed for each color, the processing time for adjusting the image density more increases.

Japanese Patent Application Laid-open No. 2006-106222 discloses an image forming apparatus that performs an image-density control process in the following manner. That is, the development index value $\gamma$ and the development start voltage Vk calculated based on a detection result obtained by the optical sensor are stored in a storage unit. Then, in a next image-density control process, developing biases used for forming toner patches are calculated, respectively, based on the development index value $\gamma$ and the development start voltage Vk stored in the storage unit so that the toner adhesion amounts of the toner patches can be evenly distributed from the small toner adhesion amount to the large toner adhesion amount within the detection range of the optical sensor. Then, the tone pattern is formed with the calculated developing biases, and the image-density control process is performed by using the tone pattern. Generally, the development index value $\gamma$ does not largely fluctuate from the previous development index value γ. Therefore, if the previous development index value γ is used when forming the toner patches, it is possible to evenly distribute the toner adhesion amounts of the toner patches from the small toner adhesion amount to the large toner adhesion amount within the detection range of the optical sensor with a small number of the toner patches. More particularly, when the development index value γ is large, all toner patches are formed with low developing biases. When the development index value γ is small, toner patches having toner adhesion amounts in a small toner adhesion amount range are formed with low developing biases while toner patches having toner adhesion amounts in a large toner adhesion amount range are formed with high developing biases. In this manner, if the developing biases for the toner patches are determined based on the previous development index value γ, the toner adhesion amounts can be evenly distributed from the small toner adhesion amount to the large toner adhesion amount within the detection range of the optical sensor with a less number of the toner patches than that in the conventional technology in which all the toner patches are formed by using the fixed developing biases, even when the development index value γ decreases or increases. Thus, the number of the toner patches can be reduced. As a result, a processing time for the image-density control process can be reduced and a consumption amount of toner by the image-density control process can also be reduced.

However, in some cases, e.g., when an image-density control process is performed after an environmental condition of an image forming apparatus largely changes or the image forming apparatus is not in use for a long time, the development index value γ may largely increases from the previous development index value γ.

If this happens, the following problem may occur in the image forming apparatus disclosed in Japanese Patent Application Laid-open No. 2006-106222. That is, among the toner patches formed with the developing biases calculated based on the previous development index value γ, only one toner patch having the smallest toner adhesion amount is within the detection range of the optical sensor, which makes calculation of the development index value γ difficult. In this case, in the image forming apparatus disclosed in Japanese Patent Application Laid-open No. 2006-106222, the tone pattern is formed again by changing a developing bias or increasing the number of the toner patches contained in the tone pattern so that at least two different toner adhesion amounts of the toner patches can be within the detection range of the optical sensor.

However, because the tone pattern is formed again, a processing time for the image-density control process increases, increasing a downtime of the image forming apparatus. Furthermore, the toner consumption also increases.

The applicant of the present invention has proposed an image forming apparatus in Japanese Patent Application No. 2008-28139. In the image forming apparatus, some toner patches among toner patches of a tone pattern are formed under a predetermined fixed image forming condition (hereinafter, theses toner patches are referred to as "fixed toner patches" as appropriate). The rest of the toner patches are formed under an image forming condition determined based on a previous image forming condition that is adjusted in a previous process (hereinafter, these toner patches are referred to as "variable toner patches" as appropriate). The predetermined fixed image forming condition is determined such that the toner adhesion amounts can be within the detection range of the optical sensor even when the development index value γ increases.

Accordingly, when the current development index value γ does not greatly vary from the previous development index value γ used for adjusting the previous image forming condition, the toner adhesion amounts of the variable toner patches can be evenly distributed within the detection range of the optical sensor. Therefore, the development index value γ can be accurately calculated even with a small number of the toner patches. As a result, the image forming condition can be accurately adjusted.

On the other hand, when the current development index value γ largely increases from the previous development index value γ, the toner adhesion amounts of the fixed toner patches can be remained within the detection range of the optical sensor. Therefore, when the current development index value γ largely increases from the previous development index value γ, and even if only one variable toner patch has a toner adhesion amount within the detection range of the optical sensor, the toner adhesion amounts of at least two toner patches can be within the detection range of the optical sensor. Therefore, the development index value γ can be obtained and the image forming conditions can be adjusted. In other words, by performing only a single process of forming the tone pattern, the image forming condition can be adjusted. Thus, because the tone pattern need not be formed again, increase in the processing time for the image-density control process, increase in downtime of the image forming apparatus, and increase in the consumption amount of toner by the image-density control process can be prevented.

However, the following problem remains in the image forming apparatus proposed in the Japanese Patent Application No. 2008-28139. That is, in the color image forming apparatus, when the current development index value γ largely increases or largely decreases from the previous development index value γ, the calculation accuracy of the development index value γ for a certain color decreases compared to the other colors, so that the image-density control process as a whole cannot be performed accurately.

SUMMARY OF THE INVENTION

It is an object of the present invention to at least partially solve the problems in the conventional technology.

According to an aspect of the present invention, there is provided an image forming apparatus including an image forming unit including at least one image carrier that carries a latent image; at least one charging unit that charges a surface of the image carrier; a latent-image forming unit that forms a latent image on the surface of the image carrier charged by the charging unit; and a plurality of developing units that have developer carrying units containing toners of different colors, respectively, and apply developing biases to the developer carrying units to transfer the toner onto the latent image on the surface of the image carrier, so that a toner image is formed on the image carrier; a transferring unit that transfers the toner image onto an endless rotating member or on a recording medium carried by the endless rotating member; an optical detecting unit that detects a reflected light from the toner image on the endless rotating member; and a control unit that causes the image forming unit to form a plurality of tone patterns with the toners of different colors, respectively, on the image carrier and causes the transferring unit to transfer the tone patterns from the image carrier to the endless rotating member, each of the tone patterns containing a plurality of toner patches having different toner densities, calculates index values of developing performances of the developing units, respectively, based on a result of detection of the toner patches by the optical detecting unit, and controls image forming conditions for the different colors based on the index values, respectively. When forming the tone patterns the control unit provides control such that some of the toner patches in each of the tone patterns are formed under a predetermined fixed image forming condition, rest of the toner patches in each of the tone patterns are formed under previous image forming conditions, respectively, the previous image forming conditions being image forming conditions set based on the previous image forming conditions obtained by the control unit through a previous control process, and a target toner density of a largest toner density of the rest of the toner patches in each of the tone patterns is determined based on a magnitude relation of previous index values calculated by the control unit through the previous control process.

According to another aspect of the present invention, there is provided an image-density control method implemented on an image forming apparatus. The image forming apparatus including an image forming unit including at least one image carrier that carries a latent image; at least one charging unit that charges a surface of the image carrier; a latent-image forming unit that forms a latent image on the surface of the image carrier charged by the charging unit; and a plurality of developing units that have developer carrying units containing toners of different colors, respectively, and apply developing biases to the developer carrying units to transfer the toner onto the latent image on the surface of the image carrier, so that a toner image is formed on the image carrier; a transferring unit that transfers the toner image onto an endless rotating member or on a recording medium carried by the endless rotating member; an optical detecting unit that detects a reflected light from the toner image on the endless rotating member. The image-density control method including causing the image forming unit to form a plurality of tone patterns with the toners of different colors, respectively, on the image carrier and causing the transferring unit to transfer the tone patterns from the image carrier to the endless rotating member, each of the tone patterns containing a plurality of toner patches having different toner densities; calculating index values of developing performances of the developing units, respectively, based on a result of detection of the toner patches by the optical detecting unit; and controlling image forming conditions for the different colors based on the index values, respectively. When forming the tone patterns the causing includes forming some of the toner patches in each of the tone patterns under a predetermined fixed image forming condition, forming rest of the toner patches in each of the tone patterns under previous image forming conditions, respectively, the previous image forming conditions being image forming conditions set based on the previous image forming conditions obtained by the control unit through a previous control process, and determining a target toner density of a largest toner density of the rest of the toner patches in each of the tone patterns based on a magnitude relation of previous index values calculated at the calculating through the previous control process.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
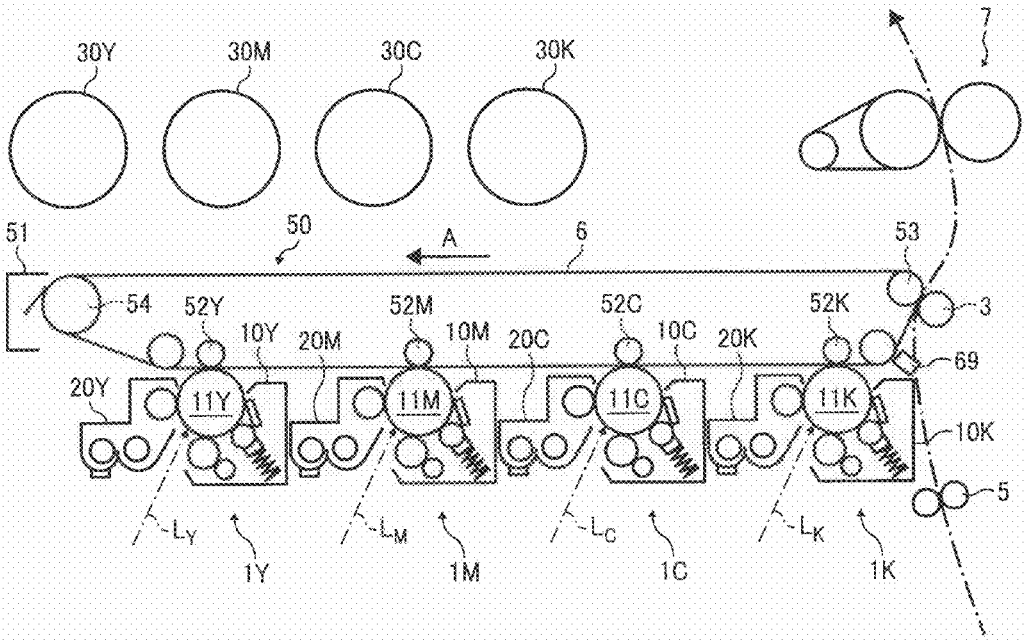
FIG. 1 is a schematic diagram of main components of a laser printer according to an embodiment of the present invention.

The applicant of the present invention keenly examined the situation where the calculation accuracy of the development index value $\gamma$ for a certain color decreases compared to the other colors when the current development index value $\gamma$ largely increases or largely decreases from the previous development index value $\gamma$, and they arrived at the following conclusion. That is, when the current development index value $\gamma$ largely increases from the previous development index value $\gamma$ due to some reason, a fluctuation amount between the previous development index value $\gamma$ and the current development index value $\gamma$ for a certain color becomes larger than those for the other colors when the previous development index value $\gamma$ for this color is smaller than those for the other colors. Furthermore, when the current development index value $\gamma$ largely decreases from the previous development index value $\gamma$ because of the large environmental change or the like, a fluctuation amount between the previous development index value γ and the current development index value γ for a certain color becomes larger than those for the other colors when the previous development index value γ for this color is larger than those for the other colors.

In the image forming apparatus proposed in Japanese Patent Application Laid-open No. 2008-28139, a target adhesion amount of the largest toner adhesion amount of the variable toner patches (hereinafter, referred to as "maximum target adhesion amount" as appropriate) is set to an amount by which a toner patch of a predetermined solid image for each color can be formed. As described above, when the current development index value γ largely increases from the previous development index value γ, a fluctuation amount between the previous development index value γ and the current development index value γ becomes the largest for a color corresponding to the smallest previous development index value γ of all the colors. Therefore, for the color corresponding to the smallest previous development index value γ, the number of the variable toner patches within the detection range of the optical detecting unit decreases compared to the other colors. As a result, the calculation accuracy of the development index value γ for this color degrades compared to the other colors.

Thus, the applicant found that when the current development index value γ largely increases or decreases from the previous development index value γ, the calculation accuracy of the development index value γ for a certain color degrades compared to the other colors.

The present invention is made to solve the above problem. In an embodiment of the present invention, the maximum target adhesion amount of the variable toner patches is set depending on a magnitude relation of the previous development index values γ. If the maximum target adhesion amount is set in proportion to the previous development index value γ for each color, the following effects can be obtained.

That is, for a color corresponding to the previous development index value γ smaller than those for the other colors, when the current development index values γ for all colors largely increase from the previous development index values γ because of a large environmental change of the image forming apparatus or the like, a fluctuation amount between the previous development index value γ and the current development index value γ for this color becomes larger compared to the other colors. Accordingly, an amount of increase in the maximum target adhesion amount for this color becomes larger compared to the other colors. In the embodiment, however, the maximum target adhesion amount for this color is set smaller than the maximum target adhesion amounts for the other colors. Therefore, even when the amount of increase in the maximum target adhesion amount becomes larger compared to the other colors, it is possible to prevent a situation in which the number of toner patches within the detection range of the optical detecting unit decreases for this color compared to the other colors. Thus, even when the current development index value γ largely increases from the previous development index value γ, it is possible to prevent degradation in the calculation accuracy of the development index value γ for a color corresponding to the previous development index value γ smaller than the previous development index values γ for the other colors.

When the current development index values γ for all the colors largely decrease from the previous development index values γ, a fluctuation amount between the previous development index value γ and the current development index value γ for a color corresponding to the previous development index value γ smaller than the previous development index values γ for the other colors becomes smaller compared to the other colors. Therefore, even when the maximum target adhesion amount for this color is decreased, it is possible to prevent a situation in which the toner adhesion amounts of the toner patches for this color are more concentrated in the small toner adhesion amount range compared to the other colors. As a result, even when the current development index value γ largely decreases from the previous development index value γ because of the large environmental change or the like, the calculation accuracy of the development index value γ can hardly be degraded.

On the other hand, for a color corresponding to the previous development index value γ larger than the previous development index values γ for the other colors, when the current development index values γ for all the colors largely increase from the previous development index values γ because of the large environmental change or the like, a fluctuation amount between the previous development index value γ and the current development index value γ for this color becomes larger compared to the other colors. Accordingly, an amount of decrease in the maximum target adhesion amount for this color becomes larger compared to the other colors. In the embodiment, however, because the maximum target adhesion amount for this color is increased compared to the other colors, even when the amount of decrease in the maximum target adhesion amount becomes larger than the maximum target adhesion amounts for the other colors, it is possible to prevent a situation in which the variable toner patches for this color are concentrated in the small toner adhesion amount range. Thus, even when the current development index value γ largely decreases from the previous development index value γ, it is possible to prevent degradation in the calculation accuracy of the development index value γ for a color corresponding to the previous development index value γ larger than those for the other colors.

Furthermore, for a color corresponding to the previous development index value γ larger than the those for the other colors, when the current development index values γ for all the colors largely increase from the previous development index values γ because of the large environmental change or the like, a fluctuation amount between the previous development index value γ and the current development index value γ becomes smaller compared to the other colors. Therefore, even when the maximum target adhesion amount for this color is increased compared to the other colors, it is possible to prevent a situation in which the number of the toner patches within the detection range of the optical detecting unit decreases for this color compared to the other colors when the current development index value γ largely increases from the previous development index value γ because of the large environmental change or the like. Thus, even when the current development index value γ largely increases from the previous development index value γ, the calculation accuracy of the current development index value γ can hardly be degraded.

In this manner, according to the embodiment, even when the current development index value γ largely increases or decreases from the previous development index value γ because of the large environmental change or the like, the current development index values γ for all the colors can be accurately calculated. Therefore, the image-density control process for all the colors can be accurately performed.

Furthermore, in the embodiment, some toner patches among all the toner patches of the tone pattern are formed with the fixed image forming condition set in advance. Therefore, if the fixed image forming condition for forming the fixed toner patches is set so that the toner adhesion amounts of the fixed toner patches can be assuredly within the detection range of the optical detecting unit, the following effects can be obtained. That is, even when the toner adhesion amount of only one of the variable toner patches is within the detection range of the optical detecting unit, because the toner adhesion amounts of the fixed toner patches are also within the detection range of the optical detecting unit, the development index value γ can be assuredly calculated. Furthermore, if the fixed image forming conditions is set so that the toner adhesion amounts of the fixed toner patches can be in the large toner adhesion amount range even when the development index value γ decreases, the following effects can be obtained. That is, when the current development index value γ largely decreases from the previous development index value γ because of the large environmental change or the like, and even if the toner adhesion amounts of the variable toner patches are concentrated in the small toner adhesion amount range, the toner adhesion amounts of the fixed toner patches can be remained in the large toner adhesion amount range. Therefore, even when the current development index value γ largely decreases from the previous development index value γ because of the large environmental change or the like, degradation in the calculation accuracy of the development index value γ can be prevented.

Exemplary embodiments of the present invention are explained in detail below with reference to the accompanying drawings. In the following embodiments, the present invention is applied to an image forming apparatus that functions as an electrophotographic color laser printer (hereinafter, "laser printer").

FIG. 1 is a schematic diagram of main components of a laser printer according to an embodiment of the present invention.

The laser printer includes four processing units 1Y, 1C, 1M, and 1K that function as image forming units that respectively form images of yellow (Y), cyan (C), magenta (M), and black (K). Hereinafter, reference numerals with symbols Y, C, M, and K denote units for yellow, cyan, magenta, and black, respectively. The processing units 1Y, 1C, 1M, and 1K include photosensitive element units 10Y, 10C, 10M, and 10K and developing units 20Y, 20C, 20M, and 20K, respectively. The photosensitive element units 10Y, 10C, 10M, and 10K include drum-type photosensitive elements 11Y, 11C, 11M, and 11K that function as latent-image carriers, respectively.

A transferring unit 50 is arranged above the processing units 1Y, 1C, 1M, and 1K in FIG. 1. The transferring unit 50 includes an endless intermediate transfer belt 6 that is rotatably extended, and rotates the intermediate transfer belt 6 in a counterclockwise direction (in a direction indicated by an arrow A in FIG. 1). The transferring unit 50 also includes a belt cleaning unit 51, four primary transfer rollers 52Y, 52C, 52M, and 52K, a secondary transfer backup roller 53, and a driving roller 54 in addition to the intermediate transfer belt 6. The intermediate transfer belt 6 is extended around the above rollers, and driven to rotate endlessly in the counterclockwise direction along with rotation of the driving roller 54. The primary transfer rollers 52Y, 52C, 52M, and 52K and the photosensitive elements 11Y, 11C, 11M, and 11K are arranged to sandwich the intermediate transfer belt 6 such that primary transfer nips are formed at the sandwiched positions. The primary transfer rollers 52Y, 52C, 52M, and 52K apply transfer bias having polarity (e.g., positive polarity) opposite to that of toner to a back surface (an inner peripheral surface of a loop) of the intermediate transfer belt 6. When the intermediate transfer belt 6 sequentially passes through the primary transfer nips for Y, M, C, and K during its endless rotation, Y, M, C, and K toner images on the photosensitive elements 11Y, 11C, 11M, and 11K are primary transferred one on top of the other onto an outer peripheral surface of the intermediate transfer belt 6, whereby a four-color superimposed toner image (hereinafter, "color image") is formed thereon. The color image is then conveyed to a secondary transfer nip between the intermediate transfer belt 6 and a secondary transfer roller 3 along with rotation of the intermediate transfer belt 6.

In the laser printer, an optical writing unit 68 (not shown in FIG. 1, see FIG. 4) that functions as a latent-image forming unit is arranged below the processing units 1Y, 1C, 1M, and 1K, and a sheet feed cassette (not shown) is arranged below the optical writing unit 68. A chain line shown in FIG. 1 indicates a conveyance path of a transfer sheet. The transfer sheet is fed from the sheet feed cassette, guided by a feed guide (not shown), and conveyed by a conveyor roller (not shown) towards a suspension position where a pair of registration rollers 5 is provided. The registration rollers 5 convey the transfer sheet towards the secondary transfer nip at a predetermined timing. Then, the color image formed on the intermediate transfer belt 6 is secondary transferred onto the transfer sheet, whereby the color image is formed thereon. A fixing unit 7 fixes the color image onto the transfer sheet, and then the transfer sheet is discharged onto a sheet discharge tray 8 (not shown).

Figure 2:
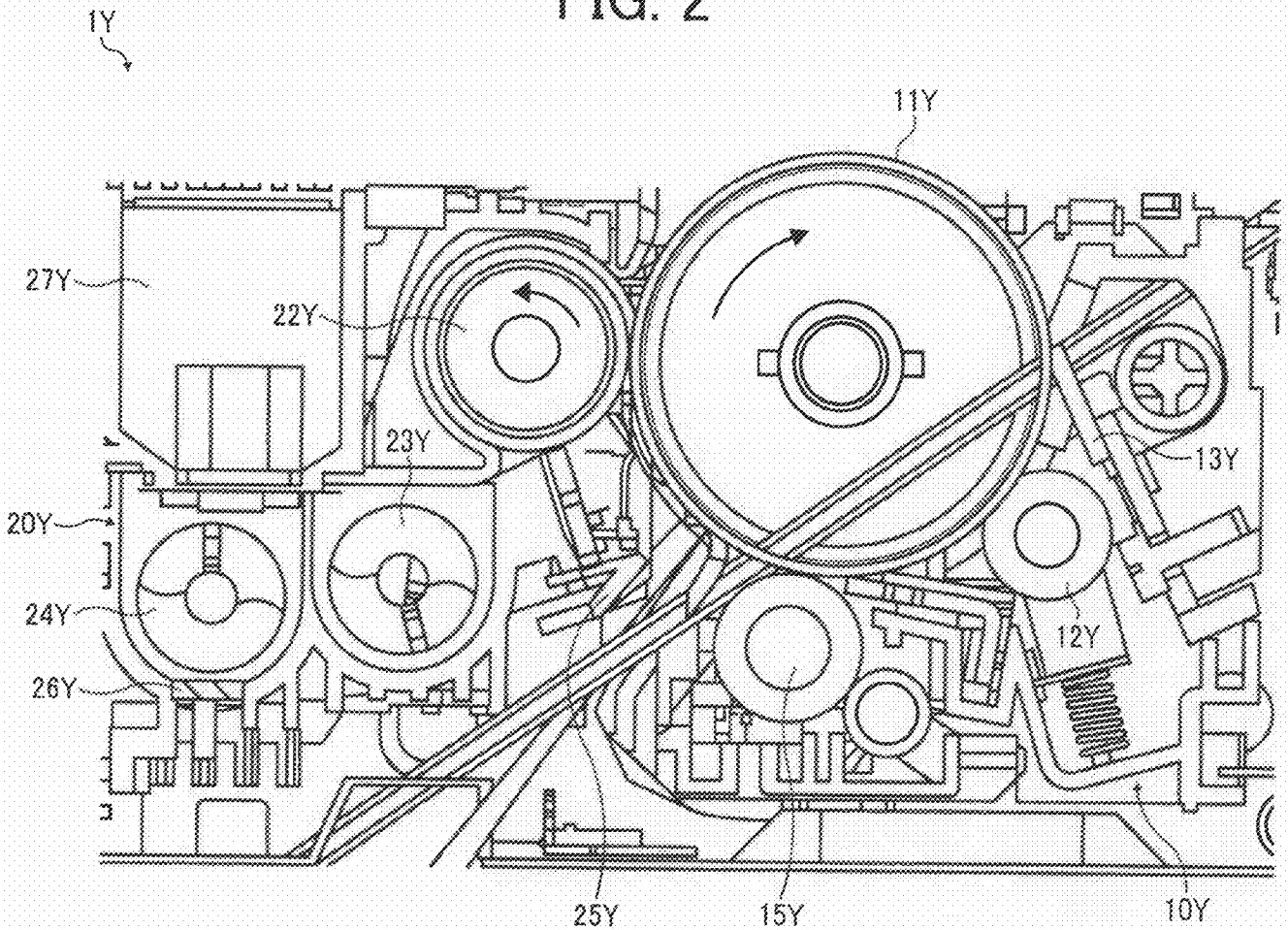
FIG. 2 is a schematic diagram of a processing unit for yellow color as a representative of processing units shown in FIG. 1.

FIG. 2 is a schematic diagram of the processing unit 1Y for yellow. Because the other processing units 1C, 1M, and 1K have the same or similar configurations as the processing unit 1Y, the same explanation will not be repeated.

As shown in FIG. 2, the processing unit 1Y includes, as described above, the photosensitive element unit 10Y and the developing unit 20Y. The photosensitive element unit 10Y includes a cleaning blade 13Y, a charging roller 15Y, and the like, in addition to the photosensitive element 11Y. The cleaning blade 13Y cleans the surface of the photosensitive element 11Y. The charging roller 15Y functions as a charging unit and uniformly charges the surface of the photosensitive element 11Y. The photosensitive element unit 10Y also includes a brush roller 12Y that functions as a lubricant applying unit that applies lubricant to the surface of the photosensitive element 11Y as well as a neutralizing unit that neutralizes the surface of the photosensitive element 11Y. The brush roller 12Y is formed of a brush portion made of conductive fiber, and a metallic core to which a power source (not shown) that applies neutralizing bias is connected.

In the photosensitive element unit 10Y having the above configuration, the charging roller 15Y to which voltage is applied charges the surface of the photosensitive element 11Y uniformly. Then, the optical writing unit 68 functioning as the latent-image forming unit irradiates the surface of the photosensitive element 11Y through scanning with a laser light $L_Y$ being modulated and deflected, so that an electrostatic latent image is formed on the surface of the photosensitive element 11Y. The electrostatic latent image on the photosensitive element 11Y is developed into a yellow toner image by the developing unit 20Y, which will be described in detail later. At the primary transfer nip where the photosensitive element 11Y is opposite the intermediate transfer belt 6, the primary transfer roller 52Y that functions as a transferring unit transfers the toner image on the photosensitive element 11Y onto the intermediate transfer belt 6. The cleaning blade 13Y that functions as a photosensitive-element cleaning unit cleans the surface of the photosensitive element 11Y after the toner image is transferred. Then, the brush roller 12Y applies a predetermined amount of lubricant onto the surface of the photosensitive element 11Y while neutralizing the surface of the photosensitive element 11Y, to prepare for formation of a next electrostatic latent image on the photosensitive element 11Y.

The developing unit 20Y develops the electrostatic latent image with two-component developer containing magnetic carrier and negatively-charged toner particles (hereinafter, simply referred to as "developer"). The developing unit 20Y includes a developing sleeve 22Y, a magnetic roller (not shown), agitation-conveyor screws 23Y, 24Y, a developing doctor 25Y, a permeability sensor (toner detection sensor) 26Y, a particle pump 27Y, and the like. The developing sleeve 22Y functions as a developer carrier, is made of nonmagnetic material, and a portion of which is exposed from an opening of a developing case (not shown) at a position opposite the photosensitive element 11Y. The magnetic roller is fixedly mounted inside the developing sleeve 22Y and functions as a magnetic-field generating unit. The agitation-conveyor screws 23Y and 24Y function as agitating units. The toner-density detection sensor 26Y functions as a toner-density detecting unit. The particle pump 27Y functions as a toner supplying unit. A developing-bias power source (not shown that functions as a developing-electric-field generating unit applies a developing bias voltage in which alternating-current voltage (alternating-current component) AC is superimposed on negative direct-current voltage (direct current component) DC to the developing sleeve 22Y, to bias the developing sleeve 22Y at a predetermined voltage with respect to a metallic base layer of the photosensitive element 11Y. It is applicable to use only the negative direct-current voltage DC as the developing bias voltage.

The agitation-conveyor screws 23Y and 24Y agitate and convey developer accommodated in the developing case, so that toner is triboelectrically charged. Then, some of the developer in a first agitation-conveyor path (not shown) on which the agitation-conveyor screw 23Y is arranged adheres to the surface of the developing sleeve 22Y. The developing doctor 25Y then adjusts a thickness of a layer of the developer on the developing sleeve 22Y, and the developing sleeve 22Y is conveyed to a developing area (not shown) opposite the photosensitive element 11Y. In the developing area, toner in the developer on the developing sleeve 22Y is transferred onto the electrostatic latent image on the photosensitive element 11Y because of the effect of a developing electric field, so that the toner image is formed. The developer that has passed through the developing area is removed from the developing sleeve 22Y at a developer removal position (not shown) of the developing sleeve 22Y, and is returned to the first agitation-conveyor path. The developer is conveyed to a downstream end of the first agitation-conveyor path, and then conveyed to an upstream end of a second agitation-conveyor path (not shown) on which the agitation-conveyor screw 24Y is arranged. Then, toner is supplied to the developer in the second agitation-conveyor path, then the developer is conveyed to a downstream end of the second agitation-conveyor path, and then conveyed to an upstream end of the first agitation-conveyor path. The toner-density detection sensor 26Y is arranged on a portion of the developing case corresponding to a bottom portion of the second agitation-conveyor path.

A toner density of the developer in the developing case decreases as toner is consumed through image formation. When the toner density decreases, the particle pump 27Y supplies toner an appropriate amount of toner from a toner cartridge 30Y shown in FIG. 1 to the developing case based on an output value Vt of the toner-density detection sensor 26Y, so that the toner density is maintained in an optimal range. The supply amount of toner is controlled based on a difference value Tn between the output value Vt and a reference output value $Vt_{ref}$ that is a toner-density-control reference value ($Tn=Vt_{ref}-Vt$). When the difference value Tn is positive, it is determined that the toner density is sufficiently high, so that toner is not supplied. On the other hand, when the difference value Tn is negative, toner is supplied in proportion to the absolute value of the difference value Tn so that the output value Vt comes close to the reference output value $Vt_{ref}$.

Among the photosensitive elements 11Y, 11C, 11M, and 11K, only the photosensitive element 11K located on the most downstream side in a moving direction of the intermediate transfer belt 6 is always in contact with the intermediate transfer belt 6, that is, a contact state of the transfer nip is always maintained. The photosensitive elements 11Y, 11C and 11M are configured such that they can be brought into contact with or out of contact with the intermediate transfer belt 6 when required. Specifically, when a color image is to be formed on a transfer sheet, all the photosensitive elements 11Y, 11C, 11M, and 11K are brought into contact with the intermediate transfer belt 6. When only a black monochrome image is to be formed on the transfer sheet, the photosensitive elements 11Y, 11C, and 11M are brought out of contact with the intermediate transfer belt 6 while the photosensitive element 11K that forms a toner image with black toner is brought into contact with the intermediate transfer belt 6.

An optical sensor 69 that functions as an optical detecting unit is arranged at a position upstream of the secondary transfer nip in the moving direction of the intermediate transfer belt 6 and opposite the outer surface of the intermediate transfer belt 6 with a predetermined spacing.

Figure 3:
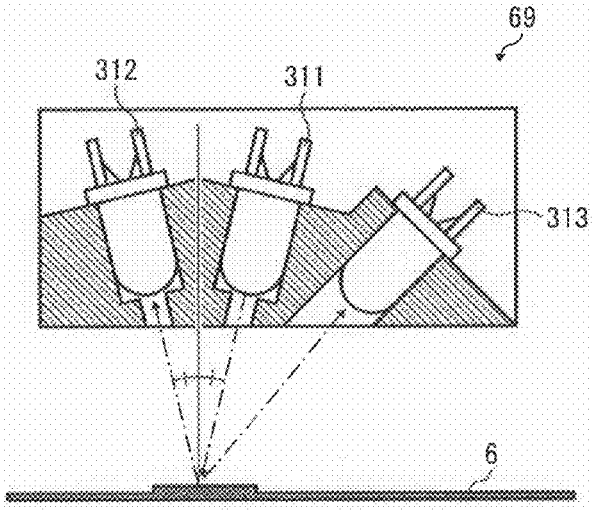
FIG. 3 is a schematic diagram of an optical sensor shown in FIG. 1.

FIG. 3 is a schematic diagram of the optical sensor 69. The optical sensor 69 includes a light emitting element 311 as a light emitting unit, a regularly-reflected-light receiving element 312 as a first light receiving unit that receives a regularly-reflected light, and a diffusely-reflected-light receiving element 313 as a second light receiving unit that receives a diffusely-reflected light. The light emitting element 311 emits a light towards the surface of the intermediate transfer belt 6. The light receiving element 312 receives a regularly-reflected light from the surface of the intermediate transfer belt 6. When a toner patch is formed on the surface of the intermediate transfer belt 6, the light receiving element 312 receives a regularly-reflected light from both the surface of the intermediate transfer belt 6 and the toner patch. The light receiving element 312 outputs a voltage corresponding to an intensity of the received light. Similarly, the light receiving element 313 receives a diffusely-reflected light from the surface of the intermediate transfer belt 6. When a toner patch is formed on the surface of the intermediate transfer belt 6, the light receiving element 313 receives a diffusely-reflected light from both the surface of the intermediate transfer belt 6 and the toner patch. The light receiving element 313 outputs a voltage corresponding to an intensity of the received light.

The light emitting element 311 is formed of a gallium arsenide (GaAs) light emitting diode (LED) having a peak emission wavelength of 940 nanometers. Each of the light receiving elements 312 and 313 is formed of a silicon (Si) phototransistor having a peak spectral sensitivity at a wavelength of 850 nanometers. In other words, the optical sensor 69 is structured to detect an infrared light having a wavelength of 830 nanometers or longer and a reflectance of which can hardly fluctuate depending on colors. Thus, because of its structure, the optical sensor 69 can detect toner patches for all colors Y, M, C, and K only by itself.

Figure 4:
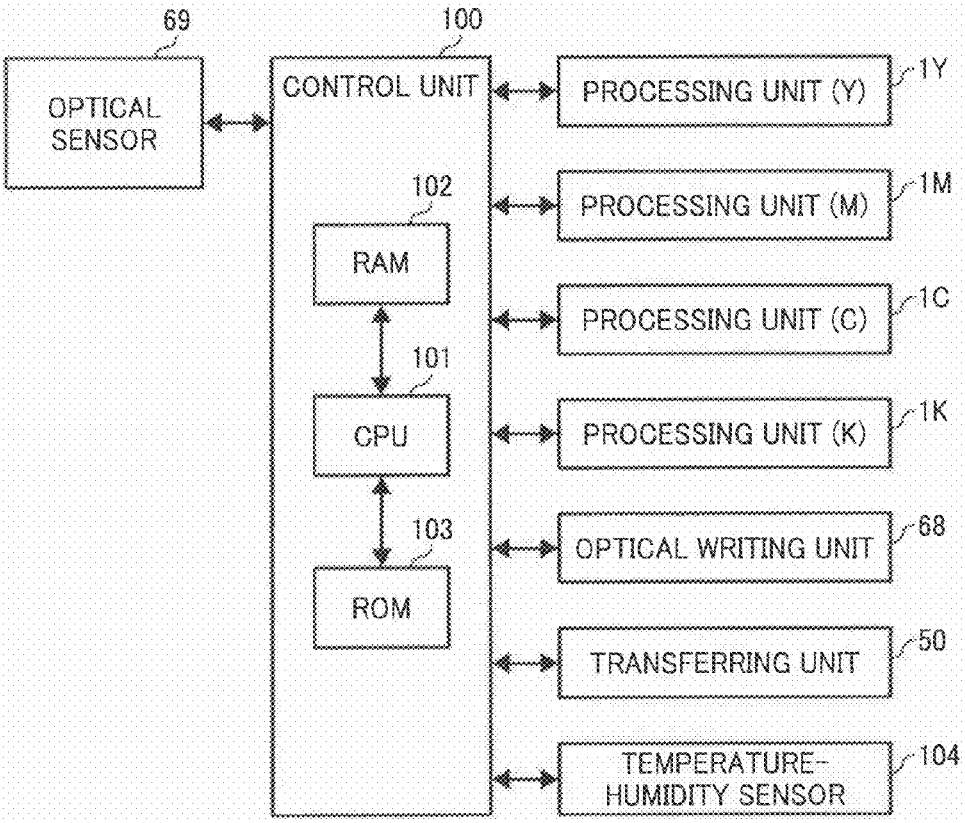
FIG. 4 is a block diagram of main components of an electrical circuit of the laser printer shown in FIG. 1.

FIG. 4 is a block diagram of main components of an electrical circuit of the laser printer. In FIG. 4, a control unit 100 includes a central processing unit (CPU) 101 that functions as a computing unit, a random access memory (RAM) 102 that is a nonvolatile memory and functions as a data storage unit, and a read only memory (ROM) 103 that functions as a data storage unit. The processing units 1Y, 1C, 1M, and 1K, the optical writing unit 68, the transferring unit 50, the optical sensor 69, a temperature-humidity sensor 104, and the like are electrically connected to the control unit 100. The control unit 100 controls these units based on a control program stored in the RAM 102 or the ROM 103.

The control unit 100 also controls image forming conditions under which images are formed. Specifically, the control unit 100 applies charging biases to the charging units in the processing units 1Y, 1C, 1M, and 1K, respectively, so that the photosensitive elements 11Y, 11C, 11M, and 11K can be uniformly charged to charge potentials for Y, M, C, and K, respectively. The control unit 100 also controls power sources of four semiconductor lasers corresponding to the processing units 1Y, 1C, 1M, and 1K, respectively, in the optical writing unit 68. The control unit 100 also applies developing biases of developing bias values for Y, M, C, and K to developing rollers (not shown) in the processing units 1Y, 1C, 1M, and 1K, respectively. Accordingly, a developing potential that causes toner on the surface of the developing sleeves 22Y, 22C, 22M, and 22K to electrostatically move to the photosensitive elements 11Y, 11C, 11M, and 11K is generated between the electrostatic latent images on the photosensitive elements 11Y, 11C, 11M, and 11K and the developing sleeves 22Y, 22C, 22M, and 22K, respectively, so that the electrostatic latent images can be developed.

The control unit 100 executes process control of an image-density control process to adjust an image density of each color every time the laser printer is powered on or printing is performed a predetermined number of times.

Figure 5:
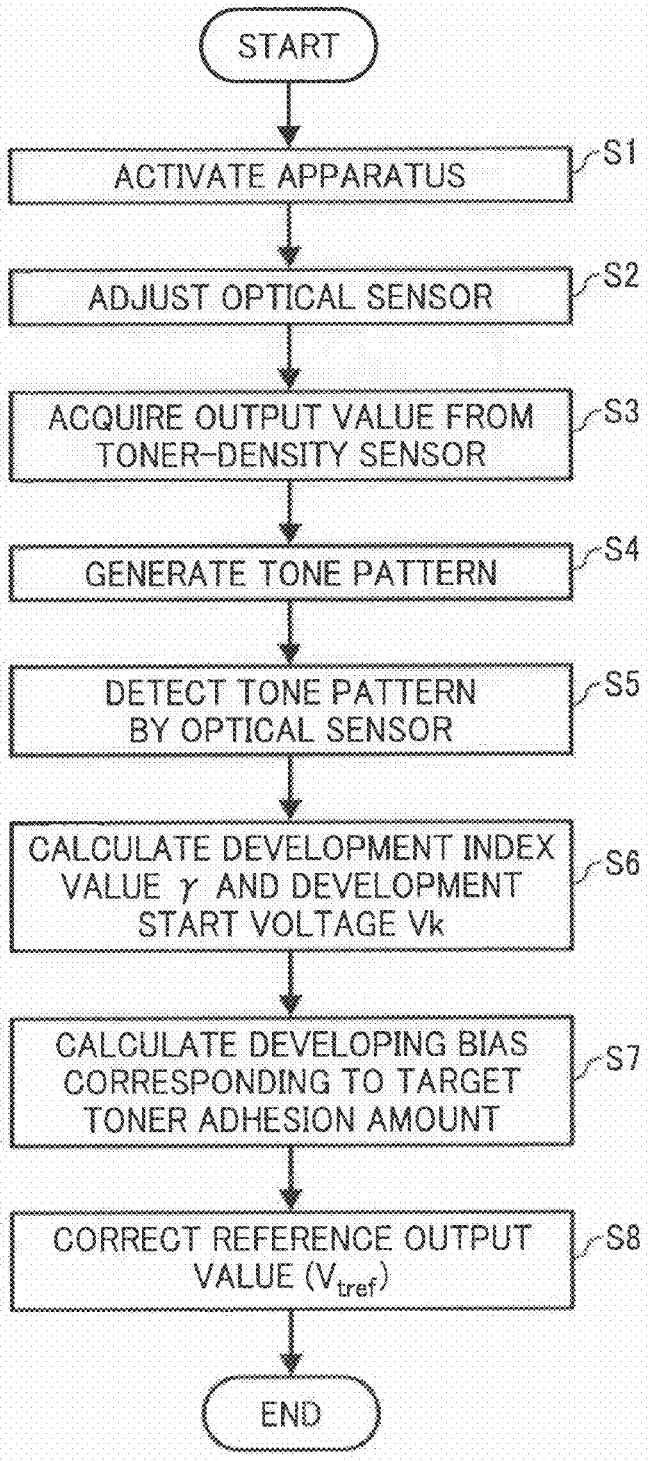
FIG. 5 is a flowchart a procedure of a process control according to the embodiment.

FIG. 5 is a flowchart of a procedure of the process control performed when the laser printer is powered on.

When the laser printer is powered on and activated (Step S1), the control unit 100 adjusts the optical sensor 69 (Step S2). Such adjustment includes, for example, controlling the intensity of a light to be emitted by the light emitting element 311 so that the light receiving element 312 can output a voltage of a predetermined value (in the embodiment, 4 volts). This adjustment of the optical sensor 69 can be omitted.

Figure 6:
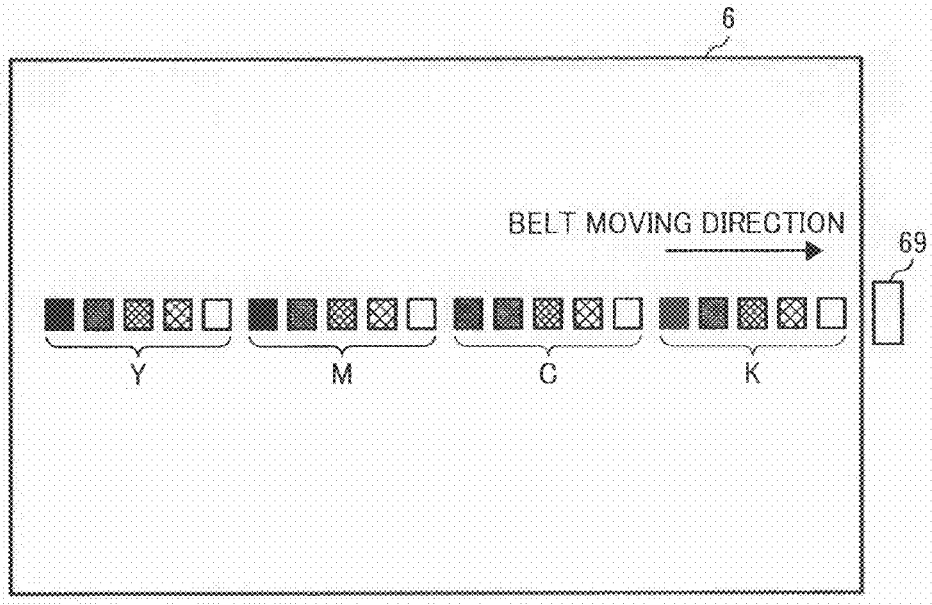
FIG. 6 is a schematic diagram of tone patterns on an intermediate transfer belt shown in FIG. 1.

The control unit 100 then acquires the output value Vt from each of the toner-density detection sensors 26Y, 26C, 26M, and 26K (Step S3), to recognize the toner density in each of the developing units 20Y, 20C, 20M, and 20K. Then, the control unit 100 causes generation of tone patterns for four colors as shown in FIG. 6 on the intermediate transfer belt 6 at positions opposite to the optical sensor 69 (Step S4). Each of the tone patterns is formed of five toner patches with different toner adhesion amounts (i.e., toner densities). The number of the toner patches is not limited to five. An interval between the adjacent toner patches is set to 5.6 millimeters, and the tone patterns for K, C, M, and Y are formed on the intermediate transfer belt 6 in that order in the moving direction of the intermediate transfer belt 6. Each of the toner patches is 10 millimeters wide in a main-scanning direction and 14.4 millimeters wide in a sub-scanning direction. When forming the tone patterns, a charging bias condition and a developing bias condition are changed with respect to each toner patch while an exposure condition is kept constant to a predetermined parameter (which enables full exposure so that the photosensitive elements 11Y, 11C, 11M, and 11K can be sufficiently neutralized). Details about settings of the developing bias and the charging bias for each of the toner patches in the tone patterns will be described later. Returning to FIG. 5, the optical sensor 69 optically detects the tone patterns for four colors on the intermediate transfer belt 6 (Step S5).

The control unit 100 then performs a conversion process to obtain a toner adhesion amount (an image density) based on an output value obtained by the light receiving elements 312 and 313 through detection of the toner patches of the tone patterns, and an adhesion-amount calculation algorithm created based on a relationship between the output value and the toner adhesion amount.

In the embodiment, similar to the technique disclosed in Japanese Patent Application Laid-open No. 2006-139180, the toner adhesion amount is calculated based on both a regularly-reflected light and a diffusely-reflected light from the toner patches. Because the toner adhesion amount is calculated by using both the regularly-reflected light and the diffusely-reflected light, a detection range for a large toner adhesion amount can be enhanced compared to when the toner adhesion amount is calculated by using only the regularly-reflected light. Furthermore, if a toner-adhesion-amount calculation algorithm disclosed in Japanese Patent Application Laid-open No. 2006-139180 is used, the toner adhesion amount can be accurately calculated even when outputs from the light emitting element 311 or the light receiving elements 312 and 313 fluctuate because of temperature change, time degradation of devices, or the like, or even when outputs from the light receiving elements 312 and 313 fluctuate because of time degradation of the intermediate transfer belt 6.

The adhesion-amount calculation algorithm according to the embodiment is described in detail below. In the following description, reference symbols are defined as follows.

Vsg: output voltage value from an optical sensor that detects a background area of the intermediate transfer belt (background detection voltage)

Vsp: output voltage value from an optical sensor that detects each toner patch (patch detection voltage)

Voffset: offset voltage (output voltage value at the time when an LED is turned off)

_reg: output of a regularly-reflected light ("reg" stands for regular reflection, see color terms defined by Japanese Industrial Standards (JIS) Z 8105)

_dif: output of a diffusely-reflected light ("dif" stands for diffuse reflection, see color terms defined by JIS Z 8105)

[n]: element count (n-array variable)

The adhesion-amount calculation algorithm for K is described in detail below.

i) The offset voltage is subtracted from the voltages of the regularly-reflected light by the following Equations.

$$\Delta Vsg_reg.[K][n]=Vsg_reg.[K][n]-V\text{offset_reg}$$

$$\Delta Vsp_reg.[K]=Vsg_reg.[K]-V\text{offset_reg}.[K]$$

ii) Regular reflection data is normalized.

$$\text{Normalized value } Rn.[K]=Vsg_reg.[K][n]/\Delta Vsp_reg.[K]$$

iii) The normalized value is converted into a toner adhesion amount by using a lookup table (LUT).

Specifically, an adhesion-amount conversion table corresponding to the normalized value is prepared in advance, and the toner adhesion amount is obtained based on the adhesion-amount conversion table.

In this manner, the adhesion-amount calculation algorithm for K is completed.

A color-toner adhesion-amount calculation algorithm for Y, C, and M is described in detail below. A toner adhesion amount for each color toner is calculated by the following Steps 1 to 7.

Step 1:

At Step 1, ΔVsp or ΔVsg is calculated through data sampling. Specifically, a difference between the voltage of the regularly-reflected light and the offset voltage, and a difference between the voltage of the diffusely-reflected light and the offset voltage are calculated for all the toner patches ([n] number of the toner patches). This is a preparation to represent an incremental amount of the output from the sensor just by an incremental amount caused by change in the adhesion amount of color toners.

The incremental amount of the output of the regularly-reflected light is obtained by the following Equation (1):

$$\Delta Vsp_\text{reg.}[n]=Vsp_\text{reg.}[n]-V\text{offset_reg} \quad (1)$$

The incremental amount of the output of the diffusely-reflected light is obtained by the following Equation (2):

$$\Delta Vsp_\text{dif.}[n]=Vsp_\text{dif.}[n]-V\text{offset_dif} \quad (2)$$

If an operational (OP) amplifier having offset voltages (i.e., Voffset_reg and Voffset_dif) negligibly small is used, the above difference calculation process can be omitted.

Figure 7:
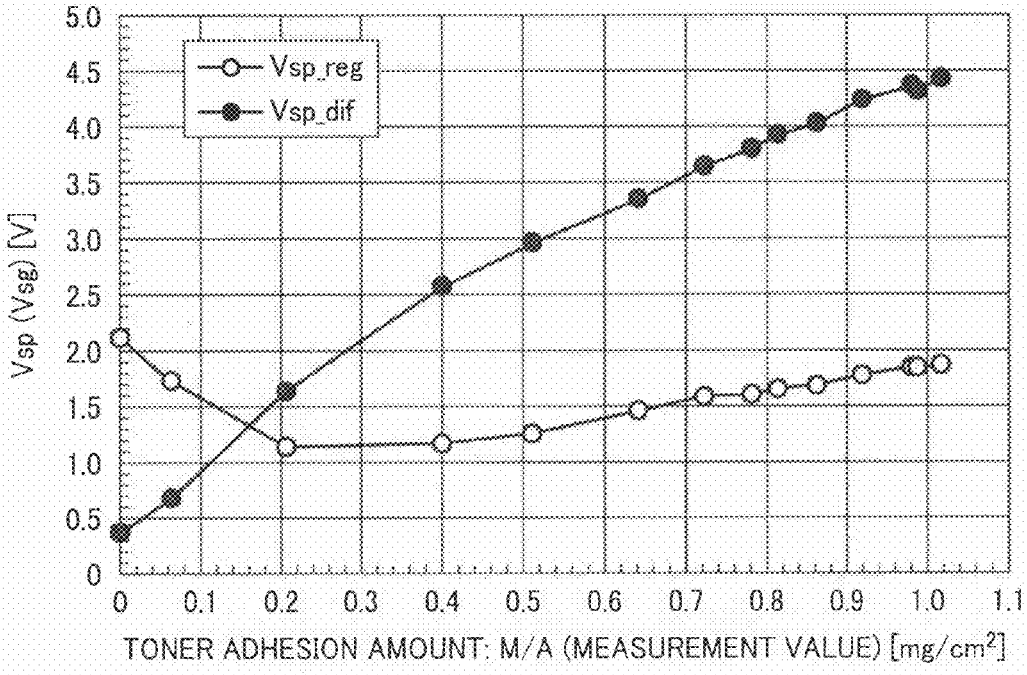
FIG. 7 is a graph of a relationship between a toner adhesion amount of a toner patch and a patch detection voltage (or a background detection voltage) according to the embodiment.

As a result of the process at Step 1, characteristic curves as shown in FIG. 7 can be obtained.

Step 2:

At Step 2, a sensitivity correction factor α is calculated. Specifically, ΔVsp_reg.[n]/ΔVsp_dif.[n] is calculated for each toner patch based on ΔVsp_reg.[n] and ΔVsp_dif.[n] obtained at Step 1. Then, the sensitivity correction factor α is calculated by the following Equation (3). The sensitivity correction factor α is to be multiplied by the output of the diffusely-reflected light (i.e., ΔVsp_dif.[n]) at Step 3 at which the output of the regularly-reflected light is decomposed, which will be described later.

$$\alpha=\min(\Delta Vsp_\text{reg.}[n]/Vsp_\text{dif.}[n]) \quad (3)$$

Figure 8:
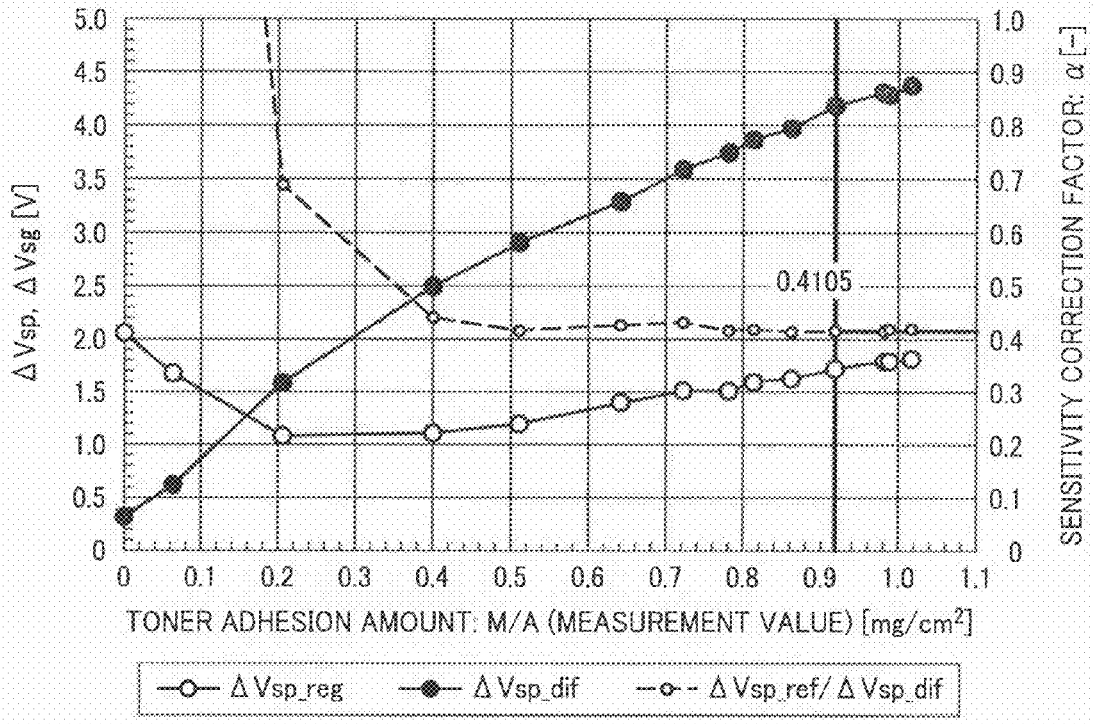
FIG. 8 is a graph of a relationship among the toner adhesion amount on the toner patch, the patch detection voltage (or the background detection voltage), and a sensitivity correction factor according to the embodiment.

As a result of the process at Step 2, characteristic curves as shown in FIG. 8 can be obtained. The reason why the sensitivity correction factor α is set to a minimum value of ΔVsp_reg.[n] and ΔVsp_dif.[n] is that it is known that the minimum value of a regular reflection component of the output of the regularly-reflected light becomes a positive value close to zero.

Step 3:

At Step 3, the output of the regularly-reflected light is decomposed.

A diffuse reflection component of the output of the regularly-reflected light is obtained by the following Equation (4):

$$\Delta Vsp_\text{reg._dif.}[n]=\Delta Vsp_\text{dif.}[n]\times\alpha \quad (4)$$

A regular reflection component of the output of the regularly-reflected light is obtained by the following Equation (5):

$$\Delta Vsp_\text{reg._reg.}[n]=\Delta Vsp_\text{reg.}[n]-\Delta Vsp_\text{reg._dif.}[n] \quad (5)$$

Figure 9:
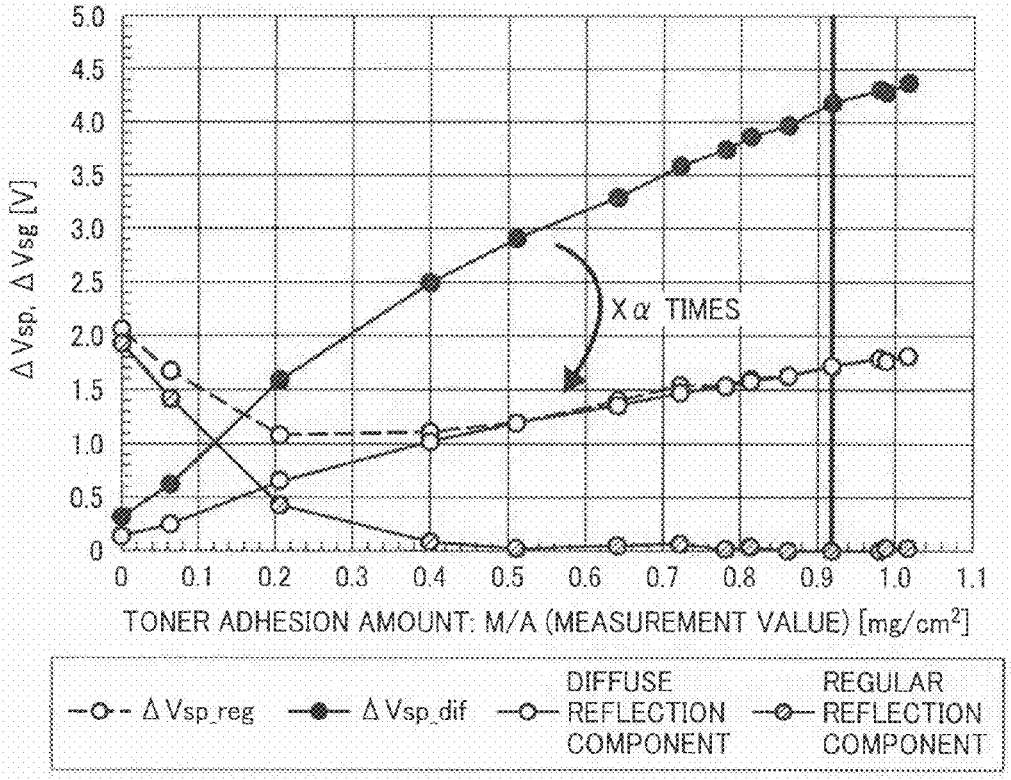
FIG. 9 is a graph of a relationship among the toner adhesion amount on the toner patch, a diffuse reflection component, and a regular reflection component according to the embodiment.

Because of the above decomposition, the regular reflection component of the output of the regularly-reflected light becomes zero at the patch detection voltage at which the sensitivity correction factor α is obtained. Thus, the output of the regularly-reflected light is decomposed to the regular reflection component and the diffuse reflection component as shown in FIG. 9.

Step 4:

At Step 4, the regular reflection component of the output of the regularly-reflected light is normalized. A ratio of each of the patch detection voltages to the background detection voltage is calculated by the following Equation (6) so that the regular reflection component can be normalized to a value in a range from zero to one:

$$\beta[n]=\Delta Vsp_\text{reg._reg}/\Delta Vsp_\text{reg._reg}\ (=\text{Exposure rate of background area of intermediate transfer belt}) \quad (6)$$

Figure 10:
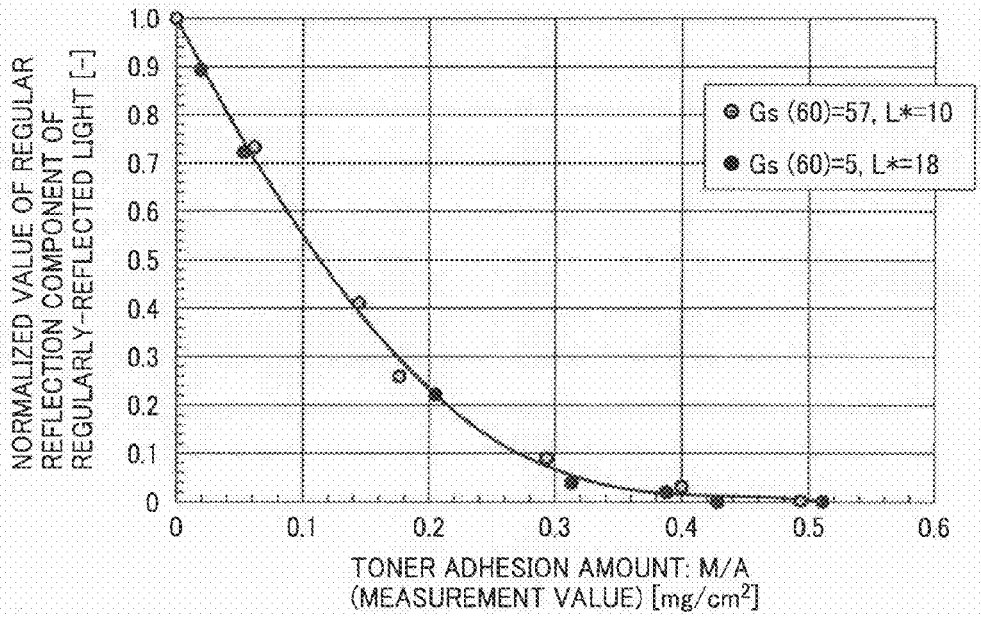
FIG. 10 is a graph of a relationship between the toner adhesion amount on the toner patch and a normalized value of a regular reflection component of a regularly-reflected light according to the embodiment.

Because of the process at Step 4, a characteristic curve as shown in FIG. 10 can be obtained.

Step 5:

At Step 5, variation of a background area (hereinafter, referred to as "background variation" as appropriate) of the intermediate transfer belt 6 is corrected with respect to the output of the diffusely-reflected light. Specifically, a diffuse reflection component obtained from the background area of the intermediate transfer belt 6 is subtracted from the output voltage of the diffusely-reflected light by the following Equation (7):

$$\Delta Vsp_\text{dif}'=[\text{Output voltage of diffusely-reflected light}]-[\text{Output from background area of intermediate transfer belt}]\times[\text{Normalized value of regular reflection component of regularly-reflected light}]=\Delta Vsp_\text{dif}(n)-\Delta Vsg_\text{dif}\times\beta(n) \quad (7)$$

Figure 11:
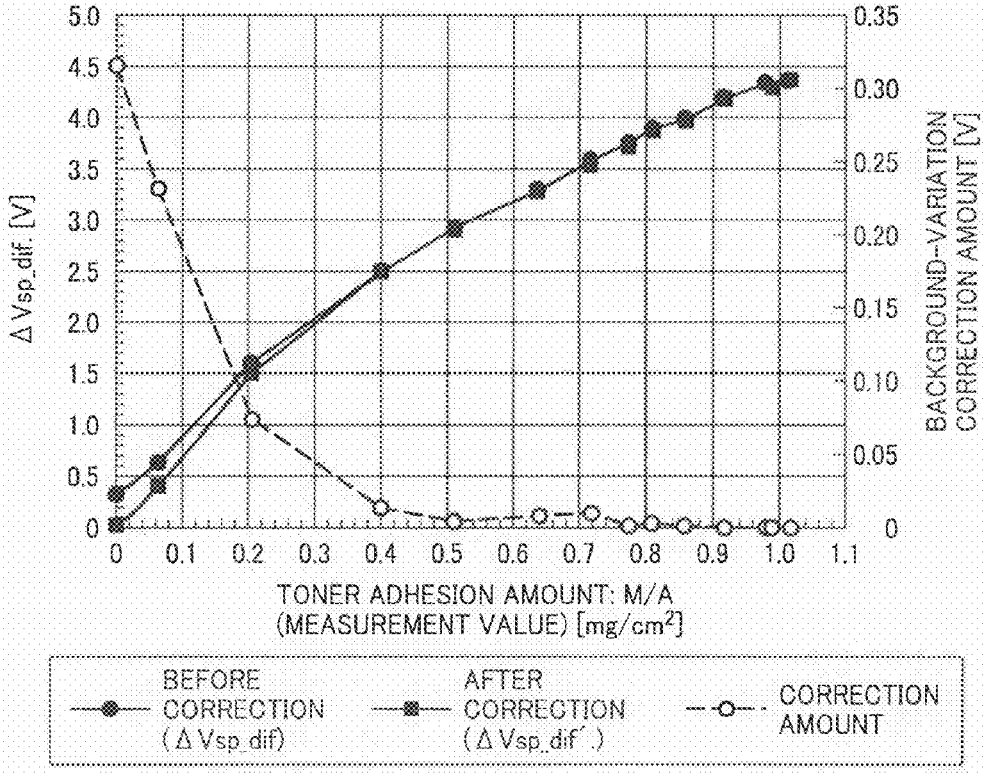
FIG. 11 is a graph of a relationship among the toner adhesion amount of the toner patch, a patch detection voltage of a diffusely-reflected light, and a background-variation correction amount according to the embodiment.

Accordingly, the effect of the background area of the intermediate transfer belt 6 can be removed. Thus, the diffuse reflection component directly reflected from the background area can be removed from the output of the diffusely-reflected light in a small toner adhesion amount range in which the output of the regularly-reflected light is detectable. Then, the corrected output of the diffusely-reflected light in a range from zero to one layer of the toner adhesion amount is converted into values having a first-order line relation with respect to the toner adhesion amount and represented by a line extended from an origin as shown in FIG. 11.

Figure 12:
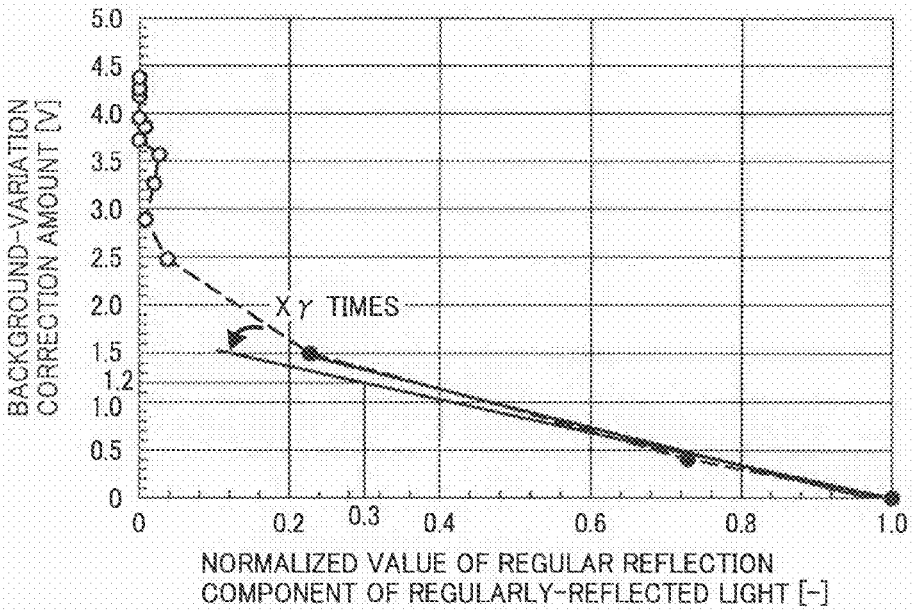
FIG. 12 is a graph of a relationship between a normalized value of a regular reflection component of a regularly-reflected light and an output of a diffusely-reflected light after background variation is corrected.

Step 6:

At Step 6, the sensitivity of the output of the diffusely-reflected light is corrected. Specifically, as shown in FIG. 12, the output of the diffusely-reflected light obtained after the background variation is corrected is plotted with respect to the normalized value of the regular reflection component of the output of the regularly-reflected light. Then, the plotted line is approximated to obtain the sensitivity of the output of the diffusely-reflected light. The sensitivity is then corrected to a predetermined desired value.

More particularly, the plotted line of the output of the diffusely-reflected light, which is obtained after the background variation is corrected, with respect to the normalized value of the regular reflection component of the output of the regularly-reflected light is approximated by polynomial approximation (in the embodiment, quadratic approximation), and then, a sensitivity correction factor η is calculated.

The plotted line is approximated by quadratic approximation (y=ξ1×2+ξ2×2+ξ3), and factors ξ1, ξ2, and ξ3 are obtained by the least square method as in the following equations (8-1), (8-2), and (8-3):

$$\xi_1\sum_{i=1}^{m}x[i]^2+\xi_2\sum_{u=1}^{m}x[i]^1+\xi_3\sum_{i=1}^{m}x[i]^0=\sum_{i=0}^{m}y[i]x[i]^0 \quad (8\text{-}1)$$

$$\xi_1\sum_{i=1}^{m}x[i]^3+\xi_2\sum_{i=1}^{m}x[i]^2+\xi_3\sum_{i=1}^{m}x[i]^1=\sum_{i=0}^{m}y[i]x[i]^1 \quad (8\text{-}2)$$

$$\xi_1\sum_{i=1}^{m}x[i]^4+\xi_2\sum_{i=1}^{m}x[i]^3+\xi_3\sum_{i=1}^{m}x[i]^2=\sum_{i=0}^{m}y[i]x[i]^2 \quad (8\text{-}3)$$

where m is the number of pieces of data, x[i] is the normalized value of the regular reflection component of the output of the regularly-reflected light, and y[i] is the output of the diffusely-reflected light obtained after the background variation is corrected.

The range of x used in the calculation is $0.1 \leqq x \leqq 1.0$.

By solving the simultaneous equations (8-1) to (8-3), the factors $\xi 1$, $\xi 2$, and $\xi 3$ can be obtained.

Then, the sensitivity correction factor $\eta$ is calculated such that a normalized value "a" calculated from the approximated plotted line can be a value "b".

Sensitivity correction factor:

$$\eta = \frac{b}{\xi_1 a^2 + \xi_2 a + \xi_3} \tag{9}$$

Then, the output of the diffusely-reflected light obtained after correcting the background variation at Step 5 is multiplied by the sensitivity correction factor $\eta$ obtained at Step 6 by the following Equation (10) so that a predetermined relationship between the adhesion amount and the output of the diffusely-reflected light can be obtained.

Output of diffusely-reflected light after correcting sensitivity: $\Delta Vsp_dif'$=[Output of diffusely-reflected light after correcting variation of background area]×[Sensitivity correction factor: $\eta$]=$\Delta Vsp_dif'(n) \times \eta$ (10)

Step 7:

At Step 7, the output value from the sensor is converted into a toner adhesion amount. Because the variation over time in the output of the diffusely-reflected light, which is caused by decrease in the light intensity of the LED or the like, has been corrected through the processes at Steps 1 to 6, the output value of the sensor is finally converted into the toner adhesion amount based on the adhesion-amount conversion table.

Thus, the color-toner adhesion-amount calculation algorithm is completed.

Figure 13:
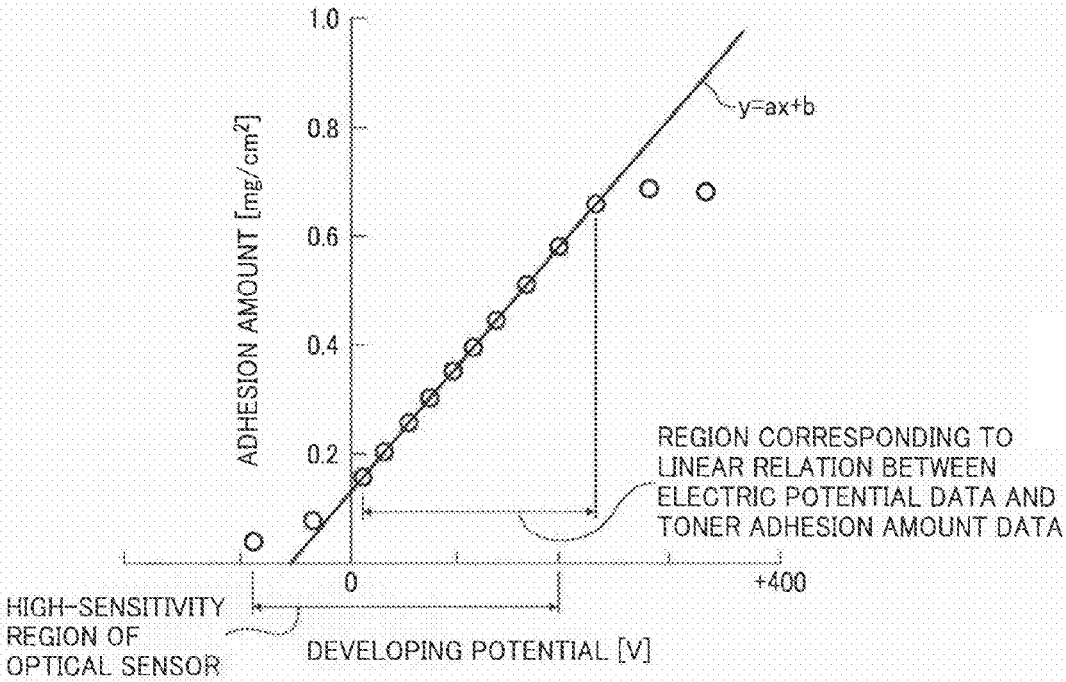
FIG. 13 is a graph of a relationship between a developing potential and a toner adhesion amount according to the embodiment.

Returning to FIG. 5, when the toner adhesion amount of each toner patch is obtained by using the above-described adhesion-amount calculation algorithms, a relationship between the toner adhesion amount of each toner patch and a developing potential used for forming each toner patch is linearly approximated (y=ax+b) by the least square method for each color, so that a line graph of developing potential versus toner adhesion amount as shown in FIG. 13 can be obtained. Then, a development index value $\gamma$ (slope "a") and a development start voltage Vk (intercept "b") of the line are calculated from the line graph of developing potential versus toner adhesion amount for each color (Step S6).

Then, the control unit 100 specifies a developing potential necessary for obtaining a predetermined target adhesion amount based on the development index value $\gamma$, and then calculates a developing bias Vb corresponding to the developing potential (Step S7). The target adhesion amount depends on the level of coloring of each toner pigment; however, it is generally within a range from 0.4 mg/cm$^2$ to 0.6 mg/cm$^2$. The control unit 100 then determines a charging bias Vc based on the developing bias Vb, and then, stores the developing bias Vb and the charging bias Vc in a nonvolatile memory such as the RAM 102. The charging bias Vc is set higher than the charging bias Vc by about 100 volts to 200 volts. The developing bias Vb is set in a range from 400 volts to 700 volts. Thus, even when the calculated developing bias is 1000 volts, the developing bias Vb is set to 700 volts. This is because, when the developing bias Vb exceeds 700 volts, a power source cannot handle such a large voltage because of overload capacity, so that the developing bias Vb may not be maintained stably. On the other hand, when the developing bias Vb is set lower than 400 volts, the charging bias Vc becomes so low that charging cannot be performed uniformly. As a result, an image may be degraded such that so-called "after image" occurs in which a previous image formed by a previous image formation is overlapped with the image.

After calculating the developing bias Vb, the control unit 100 corrects the reference output value $Vt_{ref}$ by using the development index value $\gamma$ and the output value Vt obtained by each of the toner-density detection sensors 26Y, 26C, 26M, and 26K at Step S3 (Step S8). Specifically, the control unit 100 calculates a difference value $\Delta\gamma$ between a target development index value $\gamma$ and the calculated development index value $\gamma$ ($\Delta\gamma$=(the calculated development index value $\gamma$)−(the target development index value $\gamma$)). The target development index value $\gamma$ is set to, for example, 1.0 (mg/cm$^2$)/kV, which means that, when the development start voltage Vk is zero volt and the developing potential is 1000 volts, the toner adhesion amount becomes 1.0 mg/cm$^2$. For example, when the development start voltage Vk is zero volt, the target adhesion amount is 0.5 mg/cm$^2$, and the potential Vl of the photosensitive element after exposure is 50 volts, the developing bias Vb calculated based on the target development index value $\gamma$ becomes 550 volts.

When the calculated difference value $\Delta\gamma$ is out of a predetermined range, the developing bias Vb to be obtained next time the developing bias Vb is adjusted may exceeds the above-mentioned set range. Therefore, the control unit 100 corrects the reference output value $Vt_{ref}$ so that the development index value $\gamma$ comes close to the target development index value $\gamma$ before performing a next process control. If the reference output value $Vt_{ref}$ is corrected so that the development index value $\gamma$ comes close to the target development index value $\gamma$, there may be a case in which a desired image density cannot be obtained even when the image is formed by using the calculated developing bias Vb. However, because toner is supplied such that the toner density in the developing device does not reach a target toner density at once but it gradually reaches the target toner density, the development index value $\gamma$ does not change at once. Therefore, even when correction of the reference output value $Vt_{ref}$ is started, a desired image density can be obtained for a while with the calculated developing bias, and, as time elapses, the image density gradually fluctuates from the desired image density. In the embodiment, however, the correction amount of the reference output value $Vt_{ref}$ is set so that the image density does not largely fluctuate from the desired image density even when the image is formed by the calculated developing bias after the reference output value $Vt_{ref}$ is corrected. Therefore, the image is not largely degraded. Even in this case, however, when the output value Vt from each of the toner-density detection sensors 26Y, 26C, 26M, and 26K largely fluctuates from the reference output value $Vt_{ref}$, and if the reference output value $Vt_{ref}$ is corrected, the development index value $\gamma$ cannot come close to the target development index value $\gamma$. Taking this situation into account, whether to correct the reference output value $Vt_{ref}$ is determined based on its relationship with respect to the output value Vt obtained from each of the toner-density detection sensors 26Y, 26C, 26M, and 26K when the tone patterns are formed.

For example, when $\Delta\gamma \geqq 0.30$ (mg/cm$^2$)/kV and $Vt - Vt_{ref} \geqq 0.2$ volts, the reference output value $Vt_{ref}$ is decreased by 0.2 volts so that a toner density can be decreased from the current toner density. When $\Delta\gamma \leqq -0.30$ (mg/cm$^2$)/kV and $Vt - Vt_{ref} \geqq 0.2$ volts, the reference output value $Vt_{ref}$ is increased by 0.2 volts so that the toner density can be increased from the current toner density. When −0.30 (mg/cm$^2$)/kV≦Δγ≦−0.30 (mg/cm$^2$)/kV, the reference output value $Vt_{ref}$ is not corrected.

In this manner, the process control is completed.

The developing bias and the charging bias used for forming each toner patch of the tone pattern are described in detail below.

As shown in FIG. 13, when the toner adhesion amount of the toner patch exceeds 0.6 mg/cm$^2$, output values from the optical sensor 69 become substantially constant, so that the toner adhesion amount calculated based on the output values from the optical sensor 69 also become substantially constant. In other words, the optical sensor 69 cannot sensitively detect the toner patch having the toner adhesion amount larger than a predetermined amount.

Data points used for obtaining the first-order line by the least square method to calculate the development index value γ should preferably be distributed evenly in a high-sensitivity range of the optical sensor 69, in which the toner patches can be sensitively detected by the optical sensor 69. This is because, if the data points are concentrated, accuracy of the development index value γ may degrade because of error factors. The error factors are, for example, fluctuation in the toner adhesion amount of the toner patch caused by fluctuation in frequencies of the developing sleeves 22Y, 22C, 22M, and 22K or an output error of the optical sensor 69 caused by a scratch or the like on the surface of the intermediate transfer belt 6. When the developing biases used for forming toner patches are set close to each other and thereby the toner adhesion amounts of the toner patches are set close to each other, and, if the toner adhesion amount fluctuates, the development index value γ is more affected by the fluctuation. Accordingly, the accuracy of the development index value γ degrades. Thus, to accurately calculate the development index value γ, the toner adhesion amounts of the toner patches need to be evenly distributed from a small toner adhesion amount to a large toner adhesion amount within an effective detection range of the optical sensor 69. Furthermore, the data points need to be evenly distributed to calculate the toner adhesion amounts.

In the embodiment, the optical sensor 69, which configured to detect an infrared light a reflectance of which can hardly fluctuate depending on colors, can detect reflected lights for all colors Y, M, C, and K. Therefore, the sensitivity correction factor η can be calculated by using a plurality of pieces of output data obtained by detecting the toner patches of these colors. Thus, the sensitivity correction factor η can be more efficiently calculated compared to a case when it is calculated by using a small number of toner patches.

To calculate the sensitivity correction factor η accurately, most of normalized values x of the regular reflection component of the output of the regularly-reflected light, which is calculated from detection data (output value) obtained by the optical sensor 69 detecting the toner patches for each color, need to be set such that 0.1≦x≦1.0 is satisfied and they are distributed evenly. In other words, when a large number of pieces of data are distributed evenly in a range of 0.1≦x≦1.0, polynomial approximation (in the embodiment, quadratic approximation) can be performed accurately, so that the accuracy of the sensitivity correction factor η can be increased. As the sensitivity correction factor η is directly related to the toner adhesion amount, if the sensitivity correction factor η is calculated accurately, accuracy of the toner adhesion amount obtained through conversion can be increased.

In this manner, to accurately calculate the development index value γ and the sensitivity correction factor η, the toner adhesion amounts of the toner patches for each color need to be distributed evenly within a predetermined range.

When the development index value γ increases, the development performance also increases, so that an image having a relatively large toner adhesion amount can be formed with a low developing bias. Accordingly, even when the toner patch is formed with a developing bias of a middle level, the toner adhesion amount thereof may be out of the detection range of the optical sensor 69. Therefore, to ensure the condition in which the toner adhesion amounts of the toner patches of the tone pattern are distributed evenly from a small toner adhesion amount to a large toner adhesion amount within the detection range of the optical sensor 69 even when the development index value γ increases, it is necessary to form a plurality of toner patches with low developing biases.

On the other hand, when the development index value γ decreases, the development performance also decreases, so that an image having a relatively large toner adhesion amount can be formed only with a high developing bias. Therefore, if all the toner patches of the tone pattern are formed with low developing biases, and when the development index value γ decreases, even the largest toner adhesion amount of the toner patches remains in a small toner adhesion amount range. As a result, the toner adhesion amounts of all the toner patches are concentrated in the small toner adhesion amount range. If the toner adhesion amounts of all the toner patches are concentrated in the small toner adhesion amount range, the development index value γ cannot be calculated accurately because of effects of fluctuation in the toner adhesion amounts. Therefore, to accurately calculate the development index value γ even when the development index value γ decreases, a plurality of toner patches formed with high developing biases need to be prepared in addition to the toner patches formed with low developing biases.

In this manner, to accurately calculate the development index value γ even when the development index value γ increases or decreases, the toner patches need to be formed with both low developing biases and high developing biases. Therefore, in the conventional technology, at least 10 to 17 toner patches need to be formed in one tone pattern because of necessity of forming the toner patches both with low developing biases and high developing biases. However, as the number of the toner patches increases, a processing time for adjusting an image density increases and a consumption amount of toner also increases, which is problematic. Particularly, in a color image forming apparatus that forms an image by using four color toners Y, M, C, and K, because the tone pattern is formed for each color, the processing time for adjusting the image density more increases.

Generally, the development index value γ does not largely fluctuate from a previous development index value γ. Therefore, if the toner patches of the tone pattern are formed so that the toner adhesion amounts of the toner patches can be distributed evenly from the small toner adhesion amount to the large toner adhesion amount within the detection range of the optical sensor 69 based on the development index value γ obtained by a previous process, even when the number of the toner patches is small, the toner patches can be distributed evenly from the small toner adhesion amount to the large toner adhesion amount within the detection range of the optical sensor 69.

However, in some cases, e.g., when an image-density control process is performed after an environmental condition of the image forming apparatus largely changes or the image forming apparatus has been deactivated for a long time, the development index value γ may largely increase or decrease from the previous development index value γ. When the development index value γ largely increases from the previous development index value γ, the toner adhesion amount of only one toner patch may be within the detection range of the optical sensor 69, so that the development index value γ cannot be calculated. On the other hand, when the development index value γ largely decreases from the previous development index value γ, the toner adhesion amounts of the toner patches are concentrated in the small toner adhesion amount range, so that the development index value γ cannot be accurately calculated. Such characteristic change is more likely to occur in a compact developing device that can accommodate only a small quantity of developer.

To solve the above problem, in the embodiment, some toner patches among the toner patches of the tone pattern are formed with a fixed developing bias that is a predetermined fixed image forming condition set in advance (hereinafter, these toner patches are referred to as "fixed toner patches" as appropriate). The rest of the toner patches are formed with a developing bias that is determined based on a previous developing bias obtained by a previous process, such that the toner adhesion amounts can be distributed evenly from the small toner adhesion amount to the large toner adhesion amount within the detection range of the optical sensor 69 (hereinafter, these toner patches are referred to as "variable toner patches" as appropriate). Due to this structure of the tone pattern, in the normal state, the toner adhesion amounts of the variable toner patches can be distributed evenly from the small toner adhesion amount to the large toner adhesion amount within the detection range of the optical sensor 69. Therefore, the development index value γ can be accurately calculated with a small number of the toner patches. The fixed toner patches are formed with a developing bias by which the toner adhesion amounts of the fixed toner patches can be within the detection range of the optical sensor 69 even when the development index value γ largely increases. Accordingly, even when the development index value γ largely increases from the previous development index value γ, the development index value γ can be accurately calculated.

At this state, however, the calculation accuracy of the development index value γ for a certain color decreases compared to the other colors when the development index value γ largely increases or decreases from the previous development index value γ.

This situation is described in detail below with reference to FIG. 14.

Figure 14:
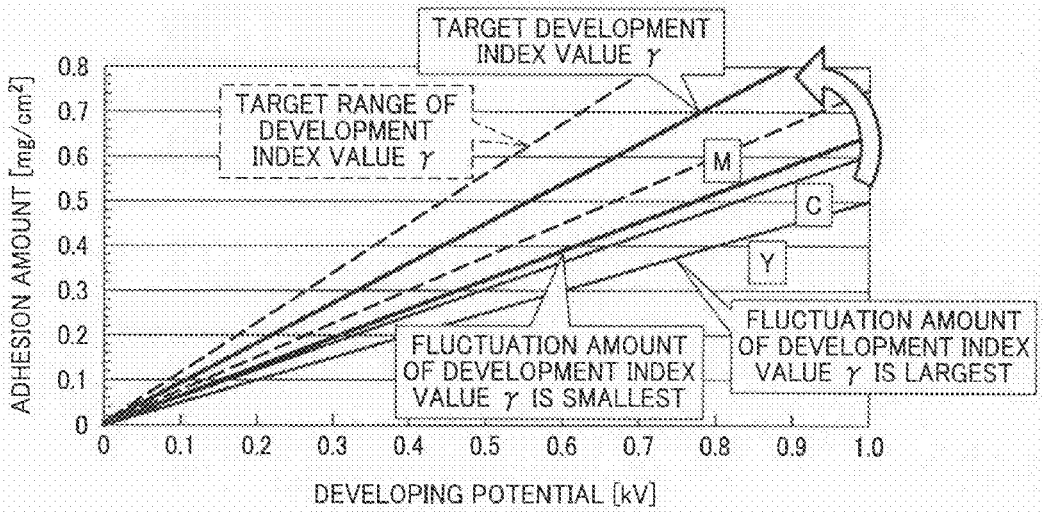
FIG. 14 is a graph illustrating variation in a development index value $\gamma$ when a previous development index value $\gamma$ is out of a target range of a development index value $\gamma$ for each color.

In the embodiment, when the calculated development index value γ is out of a range indicated by dashed lines in FIG. 14, the reference output value $Vt_{ref}$ is corrected. Specifically, when the calculated development index value γ is smaller than the range indicated by the dashed lines, the reference output value $Vt_{ref}$ is increased by 0.2. More particularly, in the example shown in FIG. 14, the reference output value $Vt_{ref}$ for each of Y, M, and C is increased by 0.2. By increasing the reference output value $Vt_{ref}$, the development index value γ obtained in a next calculation process can be increased. At this time, a fluctuation amount between the previous development index value γ and the current development index value γ for Y corresponding to the smallest previous development index value γ among the colors Y, M, and C becomes the largest among the colors Y, M, and C. On the other hand, a fluctuation amount between the previous development index value γ and the development index value γ for M corresponding to the largest previous development index value γ among the colors Y, M, and C becomes the smallest among the colors Y, M, and C. In other words, as the previous development index value γ decreases, the fluctuation amount between the previous development index value γ and the current previous development index value γ increases.

In the conventional technology, the largest toner adhesion amount of the variable toner patches for each color is set to a predetermined toner adhesion amount by which a toner patch of a predetermined solid image can be formed (in the embodiment, 0.45 mg/cm$^2$). The rest of the variable toner patches are formed so that the toner adhesion amounts thereof can be distributed evenly within a range from 0 mg/cm$^2$ to 0.45 mg/cm$^2$. Accordingly, for M, the toner adhesion amounts of all the toner patches can be within the detection range of the optical sensor 69 because the fluctuation amount between the previous development index value γ and the current development index value γ for M is relatively small. However, for Y, the largest toner adhesion amount of the variable toner patches becomes out of the detection range of the optical sensor 69 because the fluctuation amount between the previous development index value γ and the current development index value γ for Y is relatively large. Therefore, the number of pieces of data available for calculating the development index value γ for Y decreases compared to those for M, so that the calculation accuracy of the development index value γ for Y decreases compared to that for M.

On the other hand, when the previous development index values γ for these three colors are larger than the range indicated by the dashed lines in FIG. 14, and the reference output value $Vt_{ref}$ is decreased by 0.2, a fluctuation amount between the previous development index value γ and the current development index value γ for a color corresponding to the smallest previous development index value γ among the three colors becomes the largest among the three colors. Beside, a fluctuation amount between the previous development index value γ and the current development index value γ for a color corresponding to the largest previous development index value γ among the three colors becomes the smallest among the three colors. In other words, as the previous development index value γ increases, the fluctuation amount between the previous development index value γ and the current previous development index value γ increases. As a result, for a color corresponding to a small development index value γ, the fluctuation amount between the previous development index value γ and the current development index value γ becomes small, so that the toner adhesion amounts of the variable toner patches for this color are not concentrated in the small toner adhesion amount range. However, for a color corresponding to a large development index value γ (i.e., high development performance), the fluctuation amount between the previous development index value γ and the current development index value γ becomes large, so that the toner adhesion amounts of the variable toner patches for this color are concentrated in the small toner adhesion amount range. Therefore, the calculation accuracy of the development index value γ for this color degrades compared to the other colors.

While it is explained that the development index value γ for each color is changed by changing the reference output value $Vt_{ref}$, the same can be applied when the development index value γ for each color changes due to an environmental change of the image forming apparatus or the like. That is, when humidity around the image forming apparatus increase so that the development index value γ for each color largely decreases from the previous development index value γ, a fluctuation amount between the previous development index value γ and the current development index value γ becomes the largest for a color corresponding to the largest previous development index value γ of all the colors. On the other hand, when the humidity decrease so that the development index value γ for each color largely increases from the previous development index value γ, the fluctuation amount between the previous development index value γ and the current development index value γ becomes the smallest for a color corresponding to the smallest previous development index value γ of all the colors.

In the embodiment, a developing bias used for forming each variable toner patch of the tone pattern for each color is set so that the target adhesion amount of the largest toner adhesion amount of all the variable toner patches (hereinafter, referred to as "maximum target adhesion amount" as appropriate) decreases as the development index value γ decreases.

A calculation of the developing bias used for forming the tone pattern according to the embodiment is described in detail below. It is assumed that four variable toner patches are formed with developing biases that are set based on previously-adjusted developing biases, and one fixed toner patch is formed with a predetermined fixed developing bias. The number of the variable toner patches and the number of the fixed toner patches are not limited to these examples.

A calculation of the developing bias of each of the variable toner patches is described below.

The developing bias Vb for each color obtained based on the result of the previous process control is acquired, and then a maximum developing potential PotMax is obtained. The maximum developing potential PotMax can be obtained by the following Equation (11).

$$\text{Maximum developing potential: PotMax}=(\text{Developing bias: } Vb)-(\text{Solid-area exposed potential: } Vl)\ [-V] \quad (11)$$

where a solid-area exposed potential Vl is a potential of the photosensitive element after exposure, which depends on the characteristic of the photosensitive element. In the embodiment, the solid-area exposed potential Vl is set to minus 50 volts. For example, when the developing bias Vb of minus 550 volts is obtained based on the result of the previous process control, the maximum developing potential PotMax becomes such that PotMax=|−550−(−50)|=minus 500 volts.

In this manner, the maximum developing potential PotMax for each color is obtained by Equation (11).

Then, a developing bias for each of the variable toner patches of the tone pattern for each color is calculated based on the maximum developing potential PotMax for each color. At this time, a calculation method for K is different from that for C, M, and Y. This is because, in the embodiment, the toner adhesion amount for K is calculated only by using the regularly-reflected light while the toner adhesion amounts for C, M, and Y are calculated by using both the regularly-reflected light and the diffusely-reflected light as described above.

[For K Color]

In case of K, an irradiated light is absorbed by the surface of toner, so that the diffusely-reflected light cannot be detected. Therefore, the toner adhesion amount for K is detected by using only the regularly-reflected light. When the toner adhesion amount is detected by using only the regularly-reflected light, the sensitivity of the optical sensor 69 decreases as the toner adhesion amount increases. Therefore, a detection range for the toner adhesion amount becomes smaller than that for the toner adhesion amount detected by using both the diffusely-reflected light and the regularly-reflected light as in the case of C, M, and Y. Thus, the developing bias for forming the tone pattern for K is calculated differently from those for forming the tone patterns for C, M, and Y.

More particularly, the maximum developing potential PotMax for K obtained by Equation (11) is assigned to the following Equation (12) to obtain the developing bias for the tone pattern for K.

$$VPn(K)=\text{PotMax}(K)\times 2n/12-(\text{Solid-area exposed potential: } Vl)[-V] \quad (12)$$

where Vpn is a developing bias for each toner patch and n of Vpn is the order of each toner patch in the tone pattern (n-th order).

Thus, the developing bias Vpn for forming each toner patch of the tone pattern for K is calculated as follows.

$$Vp1(K)=\text{PotMax}(K)\times(2/12)-Vl[-V]$$

$$Vp2(K)=\text{PotMax}(K)\times(4/12)-Vl[-V]$$

$$Vp3(K)=\text{PotMax}(K)\times(6/12)-Vl[-V]$$

$$Vp4(K)=\text{PotMax}(K)\times(8/12)-Vl[-V]$$

[For C, M, and Y colors]

For the tone patterns for C, M, and Y, the magnitudes of the maximum developing potentials PotMax for C, M, and Y, which are obtained by Equation (11), are compared to one another, and are ranked according to their magnitudes. Here, the maximum developing potentials PotMax for C, M, and Y are represented by PotMax(1), PotMax(2), and PotMax(3) in descending order. For example, when the magnitudes of the maximum developing potentials PotMax descend in order of C, M, and Y, the maximum developing potential PotMax(1) corresponds to the maximum developing potential PotMax (C), the maximum developing potential PotMax(2) corresponds to the maximum developing potential PotMax(M), and the maximum developing potential PotMax(3) corresponds to the maximum developing potential PotMax(Y). If the maximum developing potentials PotMax are the same for all the colors, the maximum developing potentials PotMax are ranked in order of C, M, and Y.

Then, the ranked maximum developing potentials PotMax are assigned to the following Equation (13), so that a developing bias for each tone pattern is obtained.

$$VPn(m)=\text{PotMax}(m)\times\{(m+3(n-1))\}/12--(\text{Solid-area exposed potential: } Vl)[-V] \quad (13)$$

where n of Vpn(m) is an order of each toner patch of the tone pattern for each color (n-th order), and m of Vpn(m) is an order of biasing (1, 2, or 3).

Specifically, based on Equation (13), the developing bias of each toner patch of the tone pattern for each color is represented as follows.

$$VP1(1)=\text{PotMax}(1)\times(1/12)-Vl$$

$$VP1(2)=\text{PotMax}(2)\times(2/12)-Vl$$

$$VP1(3)=\text{PotMax}(3)\times(3/12)-Vl$$

$$VP2(1)=\text{PotMax}(1)\times(4/12)-Vl$$

$$VP2(2)=\text{PotMax}(2)\times(5/12)-Vl$$

$$VP2(3)=\text{PotMax}(3)\times(6/12)-Vl$$

$$VP3(1)=\text{PotMax}(1)\times(7/12)-Vl$$

$$VP3(2)=\text{PotMax}(2)\times(8/12)-Vl$$

$$VP3(3)=\text{PotMax}(3)\times(9/12)-Vl$$

$$VP4(1)=\text{PotMax}(1)\times(10/12)-Vl$$

$$VP4(2)=\text{PotMax}(2)\times(11/12)-Vl$$

$$VP4(3)=\text{PotMax}(3)\times(12/12)-Vl$$

Figure 15:
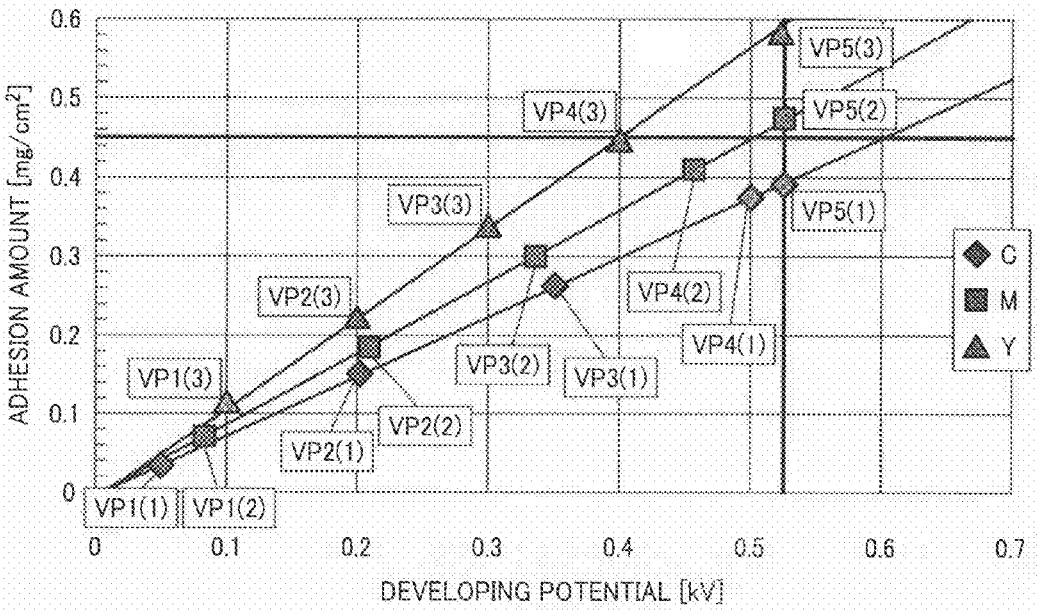
FIG. 15 is a graph illustrating calculated developing biases of toner patches in a tone pattern for each color.

When PotMax(1)=PotMax(C), PotMax(2)=PotMax(M), and PotMax(3)=PotMax(Y), the toner adhesion amounts as shown in FIG. 15 are obtained. In other words, the toner patches for Y corresponding to the smallest maximum developing potential of all the colors (i.e., the development index value γ is the largest of all the colors) are formed in the large toner adhesion amount range. The toner patches for C corresponding to the largest maximum developing potential of all the colors (i.e., the development index value γ is the smallest of all the colors) are formed in the small toner adhesion amount range.

Then, for all the colors Y, M, and C, the magnitudes of the maximum developing potentials calculated based on the previous developing bias Vb are compared to one another, and ranked in descending order. The developing bias for the tone pattern for each color is then set so that the maximum target adhesion amount of the toner patches of each tone pattern decreases as the developing potential increases (i.e., as the previous development index value γ decreases) based on the ranked order.

Figure 16:
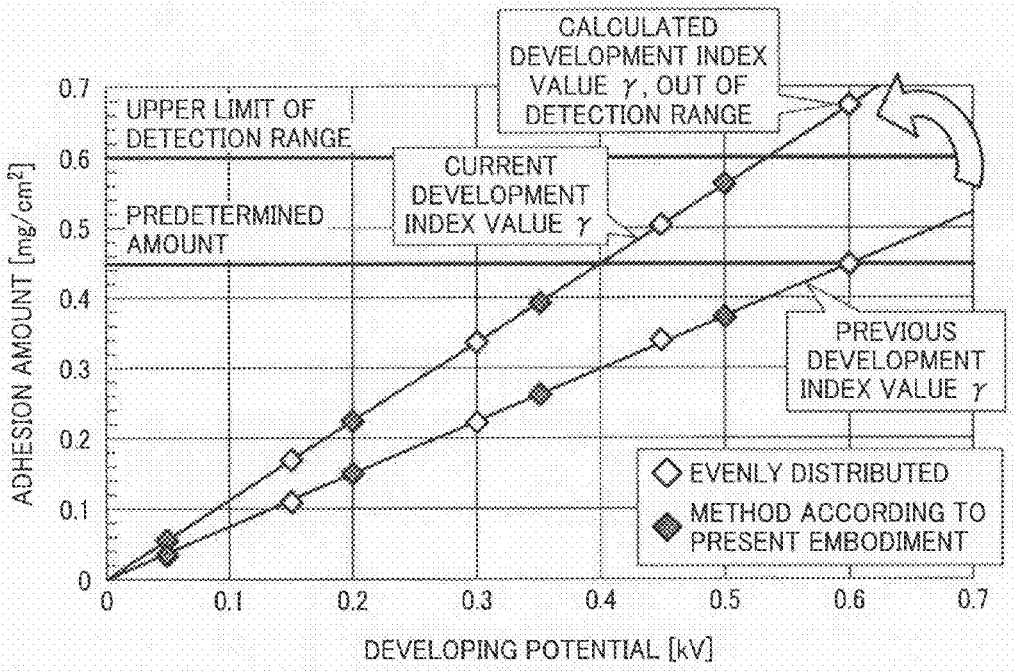
FIG. 16 is a graph for explaining an effect according to the embodiment.

FIG. 16 is a graph illustrating a difference between the current development index value γ and the previous development index value γ for C corresponding to the largest maximum developing potential of all the colors Y, M, and C (i.e., the previous development index value γ for C is the smallest of all the colors), when the maximum target adhesion amount is set to a value by which a variable tone pattern of a predetermined solid image can be formed and the toner adhesion amounts of all the variable toner patches can be distributed evenly, and when the maximum target adhesion amount is set by using the method according to the embodiment to a value smaller than the value by which the variable toner patch of the predetermined solid image can be formed. In the graph, white squares indicate the variable toner patches that are evenly distributed, and black squares indicate the variable toner patches that are formed by using the method according to the embodiment. Because the development performance for C in the previous adjustment process was low, when the environmental condition changes to a low-humidity environment and the current development index value γ largely increases from the previous development index value γ, the current development index value γ for C largely increases as shown in FIG. 16. As a result, when the maximum target adhesion amount of the variable toner patch is set to the value by which the variable toner patch of the predetermined solid image can be formed and the toner adhesion amounts of all the variable toner patches can be distributed evenly, the largest toner adhesion amount of the variable toner patches becomes out of the detection range of the optical sensor 69 as shown in FIG. 16. Thus, the number of pieces of data available for calculating the current development index value γ decreases to three. On the other hand, when the maximum target adhesion amount of the variable toner patch is set by using the method according to the embodiment to the value smaller than that by which the variable toner patch of the predetermined solid image can be formed and the toner adhesion amounts of all the variable toner patches can be distributed evenly, the toner adhesion amounts of all the variable toner patches can be within the detection range of the optical sensor 69. Therefore, the calculation accuracy of the development index value γ can hardly be degraded.

On the other hand, for M corresponding to the previous development index value γ larger than that for C (i.e., the developing potential for M is smaller than that for C), the current development index value γ less fluctuates from the previous development index value γ than for C. Therefore, even when the maximum target adhesion amount of the variable toner patch for M is set larger than that for C, the toner adhesion amounts of all the variable toner patches can be within the detection range of the optical sensor 69. Furthermore, for Y corresponding to the previous development index value γ larger than that for M (i.e., the developing potential for Y is smaller than that for M), the current development index value γ less fluctuates from the previous development index value γ than for M. Therefore, even when the maximum target adhesion amount of the variable toner patch for Y is set larger than that for M, the toner adhesion amounts of all the variable toner patches can be within the detection range of the optical sensor 69. Thus, the toner adhesion amounts of all the variable toner patches for all the colors can be within the detection range of the optical sensor 69, so that the development index values γ for all the colors can be calculated accurately.

When the environmental condition changes to a high-humidity environment and the current development index value γ largely decreases from the previous development index value γ, the current development index value γ for Y corresponding to the largest previous development index value γ of all the colors (i.e., the developing potential for Y is the smallest) largely fluctuates from the previous development index value γ. However, for Y, because the maximum target adhesion amount of the variable toner patch is set to the value by which the variable toner patch of the predetermined solid image can be formed and the toner adhesion amounts of all the variable toner patches can be distributed evenly, even when the development index value γ largely fluctuates, the toner adhesion amounts of the variable toner patches can hardly be concentrated in the small toner adhesion amount range. Furthermore, for M corresponding to the previous development index value γ smaller than that for Y (i.e., the developing potential for M is larger than that for Y), the current development index value γ less fluctuates than for Y. Therefore, even when the maximum target adhesion amount of the variable toner patch for M is set to the value smaller than that for Y, the toner adhesion amounts of all the variable toner patches can hardly be concentrated in the small toner adhesion amount range. Moreover, for C corresponding to the previous development index value γ smaller than that for M (i.e., the developing potential for C is larger than that for M), the current development index value γ less fluctuates than for M. Therefore, even when the maximum target adhesion amount of the variable toner patch for C is set to the value smaller than that for M, the toner adhesion amounts of all the variable toner patches can hardly be concentrated in the small toner adhesion amount range. Thus, because the toner adhesion amounts of the variable toner patches for all the colors can hardly be concentrated in the small toner adhesion amount range, it is possible to prevent degradation in the calculation accuracy of the development index values γ for all the colors.

Figure 17:
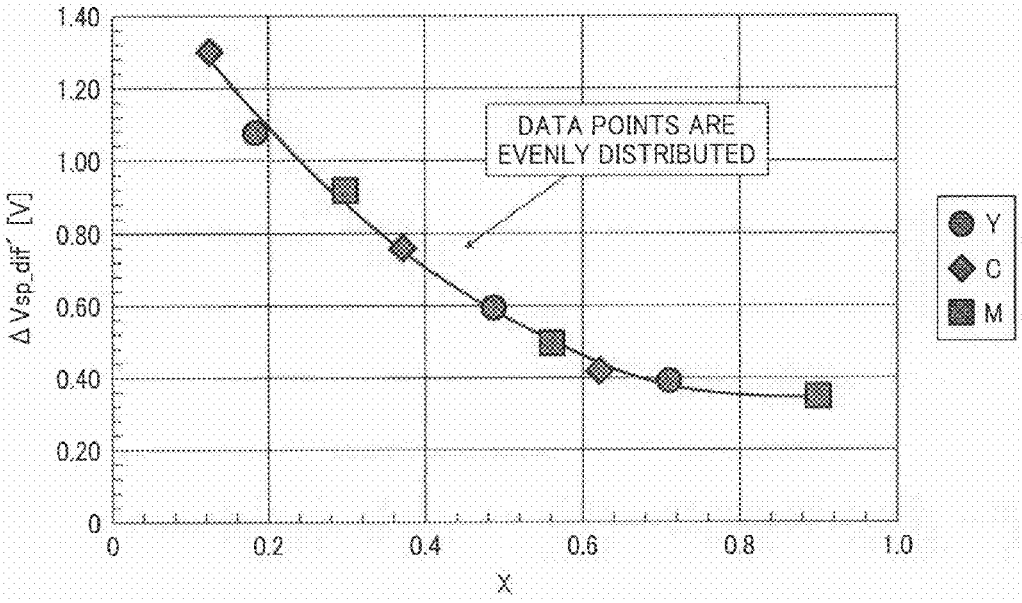
FIG. 17 is a graph illustrating a data distribution state when a sensitivity correction factor is calculated.

Besides, by setting the developing bias Vpn used for forming each toner patch of the tone pattern for each of C, M, and Y in the above manner, the toner adhesion amounts can be evenly distributed in a range of $0.1 \leqq x \leqq 1.0$ as shown in FIG. 17. Therefore, the sensitivity correction factor η can be accurately calculated.

In the embodiment, when the maximum developing potentials are the same for all the colors C, M, and Y, i.e., when the previous development index values γ are the same for all the colors, the maximum developing potentials are ranked in order of C, M, and Y. Therefore, even when the previous development index values γ are the same for all the colors, the toner adhesion amounts can be evenly distributed in a range of $0.1 \leqq x \leqq 1.0$ as shown in FIG. 17. As a result, the sensitivity correction factor η can be accurately calculated.

However, by ranking the maximum developing potentials in order of C, M, and Y when the maximum developing potentials are the same for all the colors, i.e., when the previous development index values γ are the same for all the colors, the following problem occurs. That is, for C, because the maximum target adhesion amount is decreased compared to the other colors, if the current development index value γ decreases from the previous development index value γ, the toner adhesion amounts of the variable toner patches are more concentrated in the small toner adhesion amount range compared to the other colors. As a result, the calculation accuracy of the development index value γ for C degrades. Furthermore, for Y, because the maximum target adhesion amount is increased compared to the other colors, when the current development index value γ increases from the previous development index value γ, the number of the toner adhesion amounts of the toner patches within the detection range of the optical sensor 69 decreases compared to the other colors. As a result, the calculation accuracy of the development index value γ for Y degrades.

On the other hand, when the maximum developing potentials are the same for all the colors C, M, and Y, i.e., when the previous development index values γ are the same for all the colors, and if the maximum developing potentials are not ranked in order of C, M, and Y, the toner adhesion amounts of the toner patches cannot be evenly distributed in a range of $0.1 \leqq x \leqq 1.0$. As a result, the sensitivity correction factor η cannot be accurately calculated. If the calculation accuracy of the sensitivity correction factor η decreases, the calculation accuracy of the development index value γ for all the colors also decreases. If the maximum developing potentials are ranked in order of C, M, and Y, the calculation accuracy of the development index value γ for only a single color degrades. Thus, in the embodiment, when the maximum developing potentials are the same for all the colors, i.e., when the previous development index values γ are the same for all the colors, the maximum developing potentials are ranked in order of C, M, and Y, and then the tone patterns for all the colors are formed based on the ranked order. As a result, the sensitivity correction factor η can be accurately calculated.

In the above description, the previous development index values γ for C, M, and Y are compared to one another, and the maximum target adhesion amount of the variable toner patch for each color is set so that the maximum target adhesion amount decreases as the previous development index value γ decreases based on the ranked order. Alternatively, it is applicable to compare the previous development index values γ for C, M, Y, and K to one another to set the maximum target adhesion amount of the variable toner patch for each color.

For C, Y, and M, the maximum target adhesion amounts of the variable toner patches are set in the above-described manner. For K, if the previous development index value γ for K is the largest of all the colors C, Y, M, and K, the developing bias Vpn for the variable toner patches is calculated by using Equation (12). When the previous development index value γ for K is the second largest of all the colors C, Y, M, and K, the maximum target adhesion amount of the variable toner patch for K is decreased by changing (n/12) in Equation (12) to (n/13). Furthermore, when the previous development index value γ for K is the third largest of all the colors C, Y, M, and K, the maximum target adhesion amount of the variable toner patch for K is further decreased by increasing denominator from that used when the previous development index value γ for K is the second largest. Moreover, when the previous development index value γ for K is the smallest of all the colors C, Y, M, and K, the maximum target adhesion amount of the variable toner patch for K is further decreased by further increasing the denominator.

As a result, even when the previous development index value γ for K is smaller than those for the other colors and if the current development index value γ for K more largely increases from the previous development index value γ because of the environmental change or the like compared to the other colors, because the maximum target adhesion amount of the variable toner patches for K is decreased compared to the other colors, the number of the toner adhesion amounts of the variable toner patches within the detection range of the optical sensor can hardly decreases. Furthermore, even when the current development index value γ decreases from the previous development index value γ because of the environmental change and if the current development index value γ for K more largely increases from the previous development index value γ compared to the other colors, because the maximum target adhesion amount of the variable toner patches for K is maintained, the toner adhesion amounts of the variable toner patches can hardly be concentrated in the small toner adhesion amount range. Thus, the calculation accuracy of the development index value γ for K can hardly be degraded.

The fixed toner patch is described in detail below.

The fixed toner patch is formed with a developing bias VPk of a predetermined fixed voltage. In the embodiment, the developing bias VPk is set so that the toner adhesion amount of the fixed toner patch can be within the detection range of the optical sensor 69 even when the current development index value γ largely increases from the previous development index value γ of the previous process control. More particularly, the developing bias VPk is set to minus 520 volts in the embodiment. The developing bias VPk can be set smaller than minus 520 volts. However, it is preferable to set the developing bias VPk as large as possible so that the fixed toner patch can be formed in the large toner adhesion amount range when the development index value γ largely fluctuates from a large amount to a small amount. The developing bias VPk can be set as appropriate depending on the structure of the image forming apparatus and the like.

When the current development index value γ largely decreases from the previous development index value γ, the toner adhesion amounts of the toner patches of the tone pattern are concentrated in the small toner adhesion amount range. If the toner adhesion amounts of the toner patches are concentrated in such a manner, the accuracy of the development index value γ is more likely to degrade because of effects of fluctuation in the toner adhesion amount. To prevent such a problem, it is applicable to additionally form a toner patch with a fixed developing bias so that the toner patch can have a large toner adhesion amount within the detection range of the optical sensor 69 even when the development index value γ decreases.

A setting of a charging bias VPcn used for forming a tone pattern for each color is described in detail below.

The setting of the charging bias VPcn is common to all K, C, M, and Y, and obtained by the following Equation (14).

$$\text{Charging bias: } VPc(n)[V] = Vpb(n) \times (1 + 0.01 \times \text{Background potential factor}) + \text{Background potential offset} \quad (14)$$

When setting the charging bias VPcn, a background potential offset is set to prevent a background dirt. In the embodiment, the background potential offset is set to minus 200 volts.

In this manner, in the image forming apparatus according to the embodiment, some toner patches among toner patches of the tone pattern for each color are formed as the fixed toner patches by using the predetermined fixed developing bias, which is the fixed image forming condition, and the rest of the toner patches are formed as the variable toner patches by using the developing bias set based on the previous developing bias obtained by the previous process control. Accordingly, when the current development index value γ does not largely fluctuate from the previous development index value γ, the toner adhesion amounts of the variable toner patches can be evenly distributed in the detection range of the optical sensor. Thus, the development index value γ can be accurately calculated or accurately adjusted even with a small number of the toner patches.

Furthermore, when the current development index value γ largely increases from the previous development index value γ, the toner adhesion amounts of the fixed toner patches can be within the detection range of the optical sensor. Therefore, even if the toner adhesion amount of only one variable toner patch can be within the detection range of the optical sensor when the current development index value γ largely increases from the previous development index value γ, the toner adhesion amounts of at least two tone patches can be within the detection range of the optical sensor. Therefore, the development index value γ can be obtained, and the image forming conditions can be adjusted. In this manner, because the toner adhesion amounts of at least two tone patches can be within the detection range of the optical sensor even when the current development index value γ largely increases from the previous development index value γ, the image forming conditions can be adjusted only by a single process of forming the tone pattern. Therefore, the tone pattern need not be formed again, so that increase in the image-density control time or increase in downtime of the image forming apparatus can be prevented. Furthermore, increase in the toner consumption amount by the image density control can be prevented. More particularly, this is effective for a compact image forming apparatus in which a developing unit can accommodate only a small quantity of toner and in which the toner characteristic easily fluctuates.

Moreover, in the embodiment, the maximum target adhesion amount of the variable toner patches is set depending on the magnitude relation of the previous development index values γ for all colors. Therefore, by setting the maximum target adhesion amount for a color so that it decreases as the previous development index value γ decreases, it is possible to prevent degradation in the calculation accuracy of the development index value γ for each color. Thus, the development index value γ for each color can be accurately adjusted.

Furthermore, the previous development index value γ is acquired based on the developing bias or the developing potential obtained as the image forming conditions in the previous process control. In this method, because the developing bias or the developing potential is calculated based on the development index value γ for each color, the previous development index value γ can be easily obtained based on the previous developing bias or the previous developing potential.

Moreover, when the sensitivity of the optical sensor is corrected by calculating the sensitivity correction factor η for the optical sensor by using a detection value detected by the optical sensor detecting the tone pattern for each color, if the development performances for all colors are the same, the magnitudes of the previous development index values γ are ranked based on a predetermined condition. Therefore, the toner adhesion amounts of the toner patches for each color can be evenly distributed, so that the sensitivity correction factor η can be accurately calculated.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming unit including at least one image carrier that carries a latent image;

at least one charging unit that charges a surface of the image carrier;

a latent-image forming unit that forms a latent image on the surface of the image carrier charged by the charging unit; and a plurality of developing units that have developer carrying units containing toners of different colors, respectively, and apply developing biases to the developer carrying units to transfer the toner onto the latent image on the surface of the image carrier, so that a toner image is formed on the image carrier;

a transferring unit that transfers the toner image onto an endless rotating member or on a recording medium carried by the endless rotating member;

an optical detecting unit that detects a reflected light from the toner image on the endless rotating member; and a control unit that causes the image forming unit to form a plurality of tone patterns with the toners of different colors, respectively, on the image carrier and causes the transferring unit to transfer the tone patterns from the image carrier to the endless rotating member, each of the tone patterns containing a plurality of toner patches having different toner densities, calculates index values of developing performances of the developing units, respectively, based on a result of detection of the toner patches by the optical detecting unit, and controls image forming conditions for the different colors based on the index values, respectively, wherein when forming the tone patterns the control unit provides control such that some of the toner patches in each of the tone patterns are formed under a predetermined fixed image forming condition, rest of the toner patches in each of the tone patterns are formed under previous image forming conditions, respectively, the previous image forming conditions being image forming conditions set based on the previous image forming conditions obtained by the control unit through a previous control process, and a target toner density of a largest toner density of the rest of the toner patches in each of the tone patterns is determined based on a magnitude relation of previous index values calculated by the control unit through the previous control process.

2. The image forming apparatus according to claim 1, wherein the target toner density of the largest toner density of the rest of the toner patches in each of the tone patterns is set such that a target toner density for one of the tone patterns is decreased as a magnitude of a previous index value calculated by the control unit through the previous control process for the one of the tone patterns decreases compared to other one of the tone patterns.

3. The image forming apparatus according to claim 1, wherein the control unit acquires, in a current control process, previous index values that have been calculated through the previous control process, based on the previous image forming conditions.

4. The image forming apparatus according to claim 3, wherein the previous image forming conditions correspond to at least one of a developing bias and a developing potential.

5. The image forming apparatus according to claim 4, wherein the control unit corrects sensitivity of the optical detecting unit based on a result of detection by the optical detecting unit, and when the previous index values are the same with each other, determines a magnitude relation of the previous index values based on a predetermined condition.

6. An image-density control method implemented on an image forming apparatus including an image forming unit including at least one image carrier that carries a latent image;

at least one charging unit that charges a surface of the image carrier;

a latent-image forming unit that forms a latent image on the surface of the image carrier charged by the charging unit; and a plurality of developing units that have developer carrying units containing toners of different colors, respectively, and apply developing biases to the developer carrying units to transfer the toner onto the latent image on the surface of the image carrier, so that a toner image is formed on the image carrier;

a transferring unit that transfers the toner image onto an endless rotating member or on a recording medium carried by the endless rotating member;

an optical detecting unit that detects a reflected light from the toner image on the endless rotating member, the image-density control method comprising:

causing the image forming unit to form a plurality of tone patterns with the toners of different colors, respectively, on the image carrier and causing the transferring unit to transfer the tone patterns from the image carrier to the endless rotating member, each of the tone patterns containing a plurality of toner patches having different toner densities;

calculating index values of developing performances of the developing units, respectively, based on a result of detection of the toner patches by the optical detecting unit; and controlling image forming conditions for the different colors based on the index values, respectively, wherein when forming the tone patterns the causing includes forming some of the toner patches in each of the tone patterns under a predetermined fixed image forming condition, forming rest of the toner patches in each of the tone patterns under previous image forming conditions, respectively, the previous image forming conditions being image forming conditions set based on the previous image forming conditions obtained by the control unit through a previous control process, and determining a target toner density of a largest toner density of the rest of the toner patches in each of the tone patterns based on a magnitude relation of previous index values calculated at the calculating through the previous control process.

* * * * *